US011292970B2

(12) United States Patent
Koseoglu

(10) Patent No.: US 11,292,970 B2
(45) **Date of Patent: *Apr. 5, 2022**

(54) HYDROCRACKING PROCESS AND SYSTEM INCLUDING SEPARATION OF HEAVY POLY NUCLEAR AROMATICS FROM RECYCLE BY OXIDATION

(71) Applicant: Saudi Arabian Oil Company, Dhahran (SA)

(72) Inventor: Omer Refa Koseoglu, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 153 days.

This patent is subject to a terminal disclaimer.

(21) Appl. No.: 16/674,408

(22) Filed: Nov. 5, 2019

(65) Prior Publication Data

US 2021/0130702 A1 May 6, 2021

(51) Int. Cl.

| | |
|---|---|
| ***C10G 27/00*** | (2006.01) |
| ***C10G 27/12*** | (2006.01) |
| ***C10G 67/12*** | (2006.01) |

(52) U.S. Cl.

CPC ..... *C10G 27/12* (2013.01); *C10G 67/12* (2013.01); *C10G 2300/1096* (2013.01); *C10G 2400/30* (2013.01)

(58) Field of Classification Search

CPC ..... C10G 27/04; C10G 27/12; C10G 27/14; C10G 21/12; C10G 53/04; C10G 53/14;

(Continued)

(56) References Cited

U.S. PATENT DOCUMENTS

| | | | |
|---|---|---|---|
| 4,447,315 | A | 5/1984 | Lamb et al. |
| 8,741,128 | B2 | 6/2014 | Koseoglu et al. |

(Continued)

FOREIGN PATENT DOCUMENTS

| | | | |
|---|---|---|---|
| WO | 2007006295 | A2 | 1/2007 |
| WO | 2011125042 | A1 | 10/2011 |

OTHER PUBLICATIONS

PCT International Search Report and Written Opinion from corresponding PCT Application No. PCT/US2020/057926 dated Feb. 18, 2021.

(Continued)

*Primary Examiner* — Randy Boyer
*Assistant Examiner* — Brandi M Doyle
(74) *Attorney, Agent, or Firm* — Leason Ellis LLP

(57) ABSTRACT

Hydrocracked bottoms fractions are treated to separate HPNA compounds and/or HPNA precursor compounds and produce a reduced-HPNA hydrocracked bottoms fraction effective for recycle, in a configuration of a single-stage hydrocracking reactor, series-flow once through hydrocracking operation, or two-stage hydrocracking operation. A process for separation of HPNA and/or HPNA precursor compounds from a hydrocracked bottoms fraction of a hydroprocessing reaction effluent comprises contacting the hydrocracked bottoms fraction with an effective quantity of a oxidizing agent to produce corresponding oxidized HPNA compounds and/or oxidized HPNA precursor compounds, and to form an oxidized hydrocracked bottoms fraction. The oxidized hydrocracked bottoms fraction is separated into an HPNA-reduced hydrocracked bottoms portion and an oxidized HPNA portion. All or a portion of the HPNA-reduced hydrocracked bottoms portion is recycled within the hydrocracking operation.

32 Claims, 16 Drawing Sheets

(58) Field of Classification Search
CPC ..... C10G 29/28; C10G 47/00; C10G 47/36; C10G 67/00; C10G 67/02; C10G 67/0445; C10G 67/12; C10G 2300/30; C10G 2300/1096; C10G 2400/30
See application file for complete search history.

(56) References Cited

U.S. PATENT DOCUMENTS

| | | | | |
|---|---|---|---|---|
| 8,828,219 | B2 | 9/2014 | Koseoglu | |
| 10,125,319 | B2 | 11/2018 | Koseoglu | |
| 2006/0213809 | A1* | 9/2006 | Barthelet | C10G 25/003 208/120.1 |
| 2012/0074040 | A1* | 3/2012 | Koseoglu | C10G 27/12 208/97 |
| 2012/0152804 | A1* | 6/2012 | Koseoglu | C10G 21/00 208/80 |
| 2013/0035533 | A1 | 7/2013 | Hedhli et al. | |
| 2014/0131255 | A1* | 5/2014 | Koseoglu | C10G 27/12 208/208 R |
| 2018/0187100 | A1 | 7/2018 | Koseoglu | |

OTHER PUBLICATIONS

Masoumeh Mousavi and Elham H. Fini, Non-Covalent π-Stacking Interactions between Asphaltene and Porphyrin in Bitumen, J. Chem. Inf. Model, 2020, 60, 4856-4866.

Teh Fu. Yen, J. G. Erdman and S. S. Pollack, Investigation of the Structure of Petroleum Asphaltenes by X-Ray Diffraction, Analytical Chemistry, 1961, 33, 11, 1587-1594.

* cited by examiner

HC

HYDROCRACKING PROCESS AND SYSTEM INCLUDING SEPARATION OF HEAVY POLY NUCLEAR AROMATICS FROM RECYCLE BY OXIDATION

RELATED APPLICATIONS

Not applicable.

BACKGROUND

Field of the Invention

The present invention relates to hydrocracking processes, and in particular to hydrocracking processes including separation of heavy poly nuclear aromatics from recycle streams using oxidation.

Description of Related Art

Hydrocracking processes are used commercially in a large number of petroleum refineries. They are used to process a variety of feeds boiling within the range of about 370-520° C. in conventional hydrocracking units and boiling at 520° C. and above in residue hydrocracking units. In general, hydrocracking processes split the molecules of the feed into smaller, i.e., lighter, molecules having higher average volatility and economic value. Additionally, hydrocracking processes typically improve the quality of the hydrocarbon feedstock by increasing the hydrogen-to-carbon ratio and by removing organosulfur and organonitrogen compounds. The significant economic benefit derived from hydrocracking processes has resulted in substantial development of process improvements and more active catalysts.

In addition to sulfur-containing and nitrogen-containing compounds, a typical hydrocracking feedstream, such as vacuum gas oil (VGO), contains a small amount of poly nuclear aromatic (PNA) compounds, i.e., those containing less than seven fused aromatic rings. As the feedstream is subjected to hydroprocessing at elevated temperature and pressure, heavy poly nuclear aromatic (HPNA) compounds, i.e., those containing seven or more fused benzene rings, tend to form and are present in high concentration in the unconverted hydrocracker bottoms.

Heavy feedstreams such as demetallized oil (DMO) or deasphalted oil (DAO) have much higher concentrations of nitrogen, sulfur and PNA compounds than VGO feedstreams. These impurities can lower the overall efficiency of hydrocracking units by requiring higher operating temperature, higher hydrogen partial pressure or additional reactor/catalyst volume. In addition, high concentrations of impurities can accelerate catalyst deactivation.

Three major hydrocracking process schemes include single-stage once through hydrocracking, series-flow hydrocracking with or without recycle, and two-stage recycle hydrocracking. Single-stage once through hydrocracking is the simplest of the hydrocracker configurations and typically occurs at operating conditions that are more severe than hydrotreating processes, and less severe than conventional full-pressure hydrocracking processes. It uses one or more reactors for both the treating steps and the cracking reaction, so the catalyst must be capable of both hydrotreating and hydrocracking. This configuration is cost effective, but typically results in relatively low product yields (for example, a maximum conversion rate of about 60%). Single-stage hydrocracking is often designed to maximize mid-distillate yield over single or dual catalyst systems. Dual catalyst systems can be used in a stacked-bed configuration or in two different reactors. The effluents are passed to a fractionator column to separate the $H_2S$, $NH_3$, light gases ($C_1$-$C_4$), naphtha and diesel products boiling in the temperature range of 36–370° C. The hydrocarbons boiling above 370° C. are typically unconverted bottoms that, in single stage systems, are passed to other refinery operations.

Series-flow hydrocracking with or without recycle is one of the most commonly used configurations. It uses one reactor (containing both treating and cracking catalysts) or two or more reactors for both treating and cracking reaction steps. In a series-flow configuration the entire hydrocracked product stream from the first reaction zone, including light gases (typically $C_1$-$C_4$, $H_2S$, $NH_3$) and all remaining hydrocarbons, are sent to the second reaction zone. Unconverted bottoms from the fractionator column are recycled back into the first reactor for further cracking. This configuration converts heavy crude oil fractions, i.e., vacuum gas oil, into light products and has the potential to maximize the yield of naphtha, jet fuel, or diesel, depending on the recycle cut point used in the distillation section.

Two-stage recycle hydrocracking uses two reactors and unconverted bottoms from the fractionation column are passed to the second reactor for further cracking. Since the first reactor accomplishes both hydrotreating and hydrocracking, the feed to second reactor is virtually free of ammonia and hydrogen sulfide. This permits the use of high-performance zeolite catalysts which are susceptible to poisoning by sulfur or nitrogen compounds.

A typical hydrocracking feedstock is vacuum gas oils boiling in the nominal range of 370-565° C. Heavier oil feedstreams such as DMO or DAO, alone or blended with vacuum gas oil, is processed in a hydrocracking unit. For instance, a typical hydrocracking unit processes vacuum gas oils that contain from 10V % to 25V % of DMO or DAO for optimum operation. A 100% DMO or DAO feed can also be processed, typically under more severe conditions, since the DMO or DAO stream contains significantly more nitrogen compounds (2,000 ppmw vs. 1,000 ppmw) and a higher micro carbon residue (MCR) content than the VGO stream (10 W % vs. <1 W %).

DMO or DAO content in blended feedstocks to a hydrocracking unit can lower the overall efficiency of the unit by increasing operating temperature or reactor/catalyst volume for existing units, or by increasing hydrogen partial pressure requirements or reactor/catalyst volume for grass-roots units. These impurities can also reduce the quality of the desired intermediate hydrocarbon products in the hydrocracking effluent. When DMO or DAO are processed in a hydrocracker, further processing of hydrocracking reactor effluents may be required to meet the refinery fuel specifications, depending upon the refinery configuration. When the hydrocracking unit is operating in its desired mode, that is to say, discharging a high quality effluent product stream, its effluent can be utilized in blending and to produce gasoline, kerosene and diesel fuel to meet established fuel specifications.

In addition, formation of HPNA compounds is an undesirable side reaction that occurs in recycle hydrocrackers. The HPNA molecules form by dehydrogenation of larger hydro-aromatic molecules or cyclization of side chains onto existing HPNA molecules followed by dehydrogenation, which is favored as the reaction temperature increases. HPNA formation depends on many known factors including the type of feedstock, catalyst selection, process configuration, and operating conditions. Since HPNA molecules accumulate in the recycle system and then cause equipment fouling, HPNA formation must be controlled in the hydrocracking process.

The rate of formation of the various HPNA compounds increases with higher conversion and heavier feed stocks. The fouling of equipment may not be apparent until large amounts of HPNA accumulate in the recycle liquid loop. The problem of HPNA formation is of universal concern to refiners and various removal methods have been developed by refinery operators to reduce its impact.

Conventional methods to separate or treat heavy polynuclear aromatics formed in the hydrocracking process include adsorption, hydrogenation, extraction, solvent deasphalting and purging, or "bleeding" a portion of the recycle stream from the system to reduce the build-up of HPNA compounds and cracking or utilizing the bleed stream elsewhere in the refinery. The hydrocracker bottoms are treated in separate units to eliminate the HPNA molecules and recycle HPNA-free bottoms back to the hydrocracking reactor.

As noted above, one alternative when operating the hydrocracking unit in the recycle mode is to purge a certain amount of the recycle liquid to reduce the concentration of HPNA that is introduced with the fresh feed, although purging reduces the conversion rate to below 100%. Another solution to the build-up problem is to eliminate the HPNAs by passing them to a special purpose vacuum column which effectively fractionates 98-99% of the recycle stream leaving most of the HPNAs at the bottom of the column for rejection from the system as fractionator bottoms. This alternative incurs the additional capital cost and operating expenses of a dedicated fractionation column.

The problem therefore exists of providing a process for removing HPNA compounds from the bottoms recycle stream of a hydrocracking unit that is more efficient and cost effective than the known processes.

SUMMARY

Hydrocracked bottoms fractions are treated to separate HPNA compounds and/or HPNA precursor compounds and produce a reduced-HPNA hydrocracked bottoms fraction effective for recycle, in a configuration of a single-stage hydrocracking reactor, series-flow once through hydrocracking operation, or two-stage hydrocracking operation.

A process for separation of HPNA and/or HPNA precursor compounds from a hydrocracked bottoms fraction of a hydroprocessing reaction effluent comprises contacting the hydrocracked bottoms fraction with an effective quantity of an oxidation agent. The contacting occurs under effective conditions to promote reaction with HPNA and/or HPNA precursor compounds to produce corresponding aromatic oxides and form an oxidized hydrocracked bottoms fraction. The oxidized hydrocracked bottoms fraction is separated into an HPNA-reduced hydrocracked bottoms portion and an oxidized HPNA portion. In certain embodiments, the oxidation agent used is liquid. In further embodiments, the oxidation agent is gaseous.

The above methods for separation of HPNA and/or HPNA precursor compounds by oxidation can be integrated in a hydrocracking operation using a single reactor or plural reactors in a "once-through" configuration. Accordingly, in certain embodiments a hydrocracking process for treating a heavy hydrocarbon feedstream which contains undesired nitrogen-containing compounds and poly-nuclear aromatic compounds is provided that comprises subjecting the hydrocarbon feedstream to one or more hydrocracking stages to produce a hydrocracked effluent. The hydrocracked effluent is fractioned to recover hydrocracked products and a hydrocracked bottoms fraction containing HPNA and/or HPNA precursor compounds. The hydrocracked bottoms fraction is contacted with an effective quantity of oxidation agent promote reaction with HPNA and/or HPNA precursor compounds to produce corresponding aromatic oxides and form an oxidized bottoms fraction. The oxidized hydrocracked bottoms fraction is separated into an HPNA-reduced hydrocracked bottoms portion and an oxidized HPNA portion. All or a portion of the HPNA-reduced bottoms hydrocracked portion is recycled.

In additional embodiments, the above methods for separation of HPNA and/or HPNA precursor compounds by oxidation can be integrated in a two-stage hydrocracking configuration. Accordingly, in certain embodiments, a hydrocracking process for treating a heavy hydrocarbon feedstream which contains undesired nitrogen-containing compounds and poly-nuclear aromatic compounds is provided that comprises subjecting the hydrocarbon feedstream to one or more first hydrocracking stages to produce a first stage effluent. The first stage effluent is fractioned to recover hydrocracked products and a hydrocracked bottoms fraction containing HPNA and/or HPNA precursor compounds. The hydrocracked bottoms fraction is contacted with an effective quantity of oxidation agent promote reaction with HPNA and/or HPNA precursor compounds to produce corresponding aromatic oxides and form an oxidized hydrocracked bottoms fraction. The oxidized hydrocracked bottoms fraction is separated into an HPNA-reduced hydrocracked bottoms portion and an oxidized HPNA portion. All or a portion of the HPNA-reduced hydrocracked bottoms portion is recycled.

In certain embodiments, the oxidized HPNA-containing hydrocracked bottoms fraction is separated using an aqueous separation process, a solvent extraction process that rejects the oxidized HPNA portion based on polarity, or a solvent extraction process based on aromatic selectively. In additional embodiments, the oxidized hydrocracked bottoms fraction can be separated using two or more of the separation methods described herein, for instance, an aqueous separation process followed by a solvent extraction HPNA separation process based on polarity or aromatic selectively.

In certain embodiments, a process for separation of HPNA compounds and/or HPNA precursor compounds from a hydrocracked bottoms fraction prior to recycling within a hydrocracking operation comprises: contacting the hydrocracked bottoms fraction with an effective quantity of a oxidation agent to promote reaction with HPNA and/or HPNA precursor compounds, to produce corresponding oxidized HPNA compounds and/or oxidized HPNA precursor compounds, and to form an oxidized hydrocracked bottoms fraction; separating the oxidized hydrocracked bottoms fraction into an HPNA-reduced hydrocracked bottoms portion and an oxidized HPNA portion; recycling all or a portion of the HPNA-reduced hydrocracked bottoms portion within the hydrocracking operation; and discharging the precipitated HPNA portion. In certain embodiments, two stage hydrocracking process comprises subjecting a hydrocarbon stream to a first hydrocracking stage to produce a first hydrocracked effluent; fractionating the first hydrocracked effluent to recover one or more hydrocracked product fractions and a bottoms fraction corresponding to the hydrocracked bottoms fraction of in the above process for separation of HPNA; wherein recycling all or a portion of the HPNA-reduced hydrocracked bottoms portion within the hydrocracking operation comprises passing all or a portion of the HPNA-reduced hydrocracked bottoms portion to a second hydrocracking stage to produce a second hydrocracked effluent; and optionally wherein the second hydrocracked effluent is fractionated with the first hydrocracked effluent. In certain embodiments, a hydrocracking process comprising subjecting a hydrocarbon stream to one or more hydrocracking stages to produce a hydrocracked effluent; fractionating the hydrocracked effluent to recover one or more hydrocracked product fractions and a hydrocracked bottoms fraction corresponding to the hydrocracked bottoms fraction of in the above process for separation of HPNA; and wherein recycling all or a portion of the HPNA-reduced hydrocracked bottoms portion within the hydrocracking operation comprises recycling all or a portion of the HPNA-reduced hydrocracked bottoms portion to at least one of the one or more hydrocracking stages. In certain embodiments, the oxidation agent is liquid phase. A liquid phase oxidation agent can be selected from the group consisting of peroxides, hydroperoxides, organic peracids, and combinations including at least one of peroxides, hydroperoxides or organic peracids. In additional embodiments, the oxidation agent is gas phase. A gas phase oxidation agent can be selected from the group consisting of air, oxygen, oxides of nitrogen, ozone, $SO_2$, $SO_3$ and combinations including at least one of air, oxygen, oxides of nitrogen, ozone, $SO_2$, or $SO_3$, under effective operating conditions. In certain embodiments the process further comprises contacting an additional feed with the oxidation agent.

In certain embodiments, a system for separation of HPNA compounds and/or HPNA precursor compounds from a hydrocracked bottoms fraction is provided comprising a oxidation reaction zone having one or more inlets in fluid communication with a source of oxidation agent, and one or more inlets in fluid communication with a hydrocracked bottoms outlet of a hydrocracking fractionating zone, the oxidation reaction zone having one or more outlets for discharging an oxidized hydrocracked bottoms fraction; and a separation zone having one or more inlets in fluid communication with the outlet(s) discharging the oxidation hydrocracked bottoms fraction, one or more outlets for discharging an HPNA-reduced hydrocracked bottoms portion in fluid communication with a hydrocracking operation as a bottoms recycle stream, and one or more outlets for discharging an oxidized HPNA portion. In certain embodiments, a two stage hydrocracking system comprises a first hydrocracking reaction zone having one or more inlets in fluid communication with a source of an initial feedstock, and one or more outlets for discharging a first hydrocracked effluent stream; a fractionating zone having one or more inlets in fluid communication with the outlet(s) for discharging the first hydrocracked effluent stream, one or more outlets discharging a hydrocracked product fractions, and one or more outlets discharging a hydrocracked bottoms fraction in fluid communication with the HPNA separation zone as above; a second hydrocracking reaction zone having one or more inlets in fluid communication with the outlet(s) for discharging the HPNA-reduced hydrocracked bottoms portion of the HPNA separation zone as above, and one or more outlets discharging a second hydrocracked effluent stream; and optionally wherein the outlet(s) for discharging the second hydrocracked effluent is in fluid communication with the fractioning zone. In certain embodiments, a hydrocracking system comprises a hydrocracking reaction zone having one or more inlets in fluid communication with a source of an initial feedstock and is in fluid communication with the HPNA-reduced hydrocracked bottoms portion from the outlet(s) of the HPNA separation zone as above, and one or more outlets discharging an effluent stream; and a fractionating zone having one or more inlets in fluid communication with the outlet(s) for discharging the effluent stream, one or more outlets discharging a hydrocracked product fractions, and one or more outlets discharging a hydrocracked bottoms fraction in fluid communication with the inlet(s) of the HPNA separation zone as above. In certain embodiments, the HPNA separation zone includes a contacting and/or mixing zone upstream of the oxidation reaction zone. In certain embodiments, the HPNA separation zone is also in fluid communication with a source of additional feed.

Still other aspects, embodiments, and advantages of these exemplary aspects and embodiments, are discussed in detail below. Moreover, it is to be understood that both the foregoing information and the following detailed description are merely illustrative examples of various aspects and embodiments, and are intended to provide an overview or framework for understanding the nature and character of the claimed aspects and embodiments. The accompanying drawings are included to provide illustration and a further understanding of the various aspects and embodiments, and are incorporated in and constitute a part of this specification. The drawings, together with the remainder of the specification, serve to explain principles and operations of the described and claimed aspects and embodiments.

BRIEF DESCRIPTION OF THE DRAWINGS

The invention will be described in further detail below and with reference to the attached drawings in which the same or similar elements are referred to by the same number, and where.

DETAILED DESCRIPTION

Figure 1:
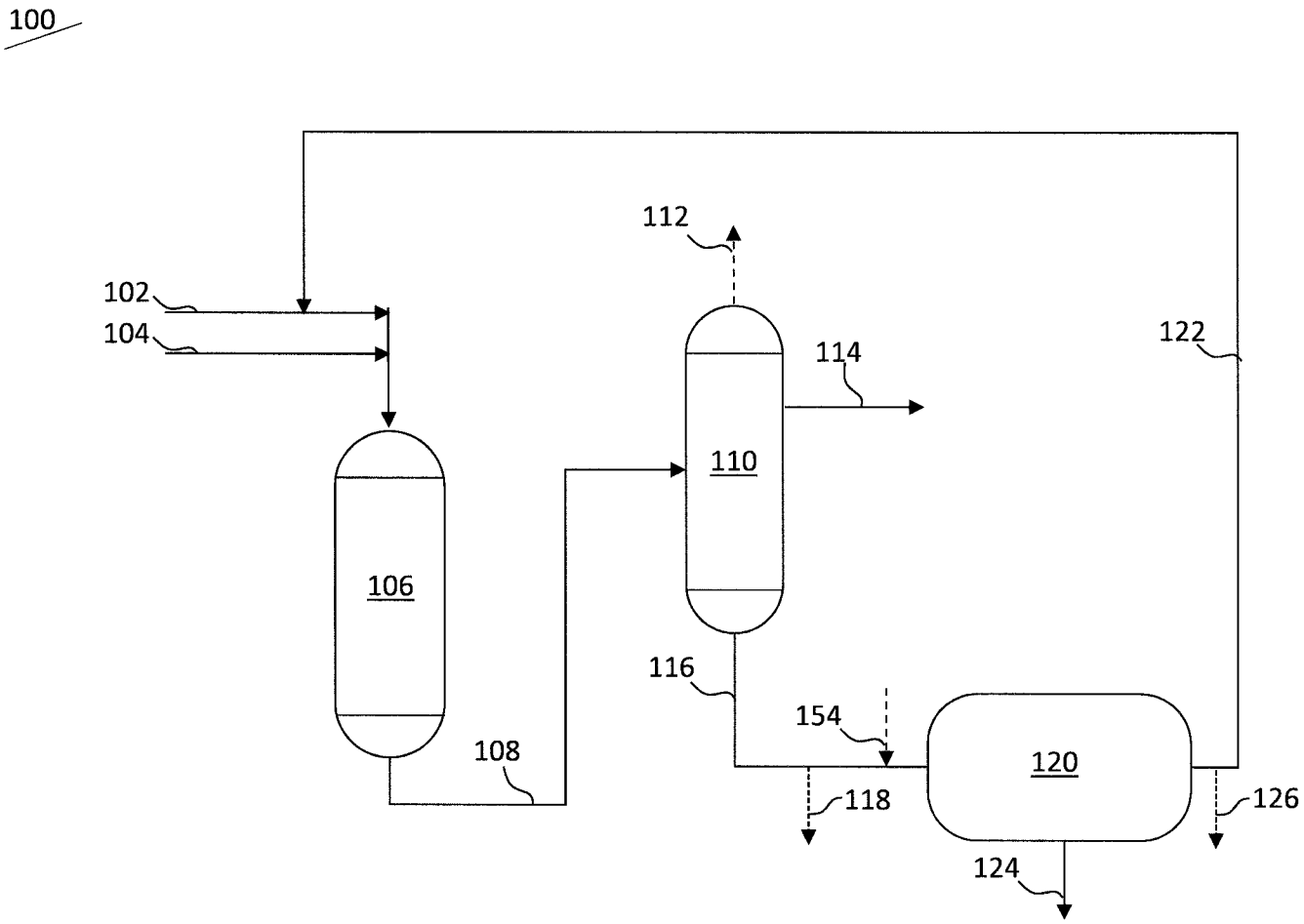
FIG. 1 is a process flow diagram of an embodiment of an integrated hydrocracking unit operation.

Integrated processes and systems are provided for to improve efficiency of hydrocracking operations, by removing HPNA and/or HPNA precursor compounds prior to recycling within a hydrocracking operation. The processes and systems herein are effective for different types of hydrocracking operations, and also effective for a wide range of initial feedstocks obtained from various sources, such as one or more of straight run vacuum gas oil, treated vacuum gas oil, demetallized oil from solvent demetallizing operations, deasphalted oil from solvent deasphalting operations, coker gas oils from coker operations, cycle oils from fluid catalytic cracking operations including heavy cycle oil, and visbroken oils from visbreaking operations. The feedstream generally has a boiling point range within about 350-800, 350-700, 350-600 or 350-565° C.

As used herein, "HPNA compounds" and the shorthand expression "HPNA(s)" refers to fused polycyclic aromatic compounds having double bond equivalence (DBE) values of 19 and above, or having 7 or more rings, for example, including but not limited to coronenes ($C_{24}H_{12}$), benzocoronenes ($C_{28}H_{14}$), dibenzocorones ($C_{32}H_{16}$) and ovalenes ($C_{32}H_{14}$). The aromatic structure may have alkyl groups or naphthenic rings attached to it. For instance, coronene has 24 carbon atoms and 12 hydrogen atoms. Its double bond equivalency (DBE) is 19. DBE is calculated based on the sum of the number double bonds and number of rings. For example, the DBE value for coronene is 19 (7 rings+12 double-bonds). Examples of HPNA compounds are shown in Table 1.

TABLE 1

| HPNAs | Ring # | Structure |
|---|---|---|
| benzoperylene | 6 | 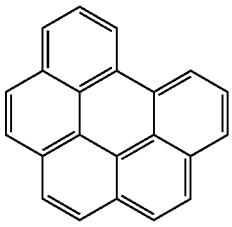 |
| coronene | 7 | 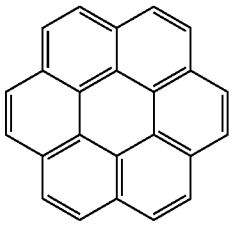 |

TABLE 1-continued

| HPNAs | Ring # | Structure |
|---|---|---|
| methylcoronene | 7 | 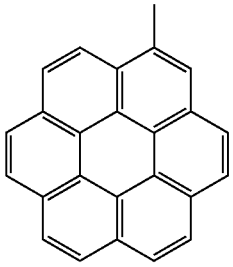 |
| naphthenocoronene | 7 | 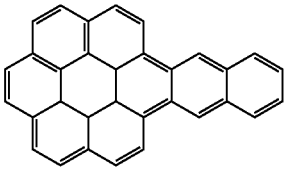 |
| dibenzocoronene | 9 | 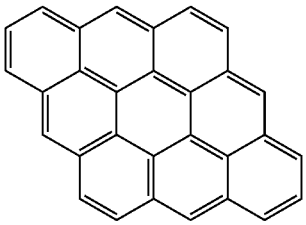 |
| ovalene | 10 | 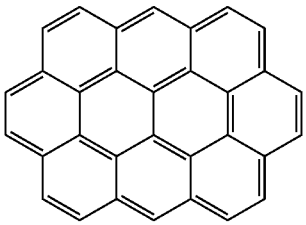 |

As used herein, "HPNA precursors" are poly nuclear compounds having less than 7 aromatic rings.

As used herein, the term hydrocracking recycle stream is synonymous with the terms hydrocracker bottoms, hydrocracked bottoms, hydrocracker unconverted material and fractionator bottoms.

As used herein, the shorthand expressions "HPNAs/HPNA precursors," "HPNA compounds and HPNA precursor compounds," "HPNAs and HPNA precursors," and "HPNA compounds and/or HPNA precursor compounds" are used interchangeably and refer to a combination of HPNA compounds and HPNA precursor compounds unless more narrowly defined in context.

Volume percent or "V %" refers to a relative at conditions of 1 atmosphere pressure and 15° C.

The phrase "a major portion" with respect to a particular stream or plural streams, or content within a particular stream, means at least about 50 wt % and up to 100 wt %, or the same values of another specified unit.

The phrase "a significant portion" with respect to a particular stream or plural streams, or content within a particular stream, means at least about 75 wt % and up to 100 wt %, or the same values of another specified unit.

The phrase "a substantial portion" with respect to a particular stream or plural streams, or content within a particular stream, means at least about 90, 95, 98 or 99 wt % and up to 100 wt %, or the same values of another specified unit.

The phrase "a minor portion" with respect to a particular stream or plural streams, or content within a particular stream, means from about 1, 2, 4 or 10 wt %, up to about 20, 30, 40 or 50 wt %, or the same values of another specified unit.

The term "naphtha" as used herein refers to hydrocarbons boiling in the range of about 20-220, 20-210, 20-200, 20-190, 20-180, 20-170, 32-220, 32-210, 32-200, 32-190, 32-180, 32-170, 36-220, 36-210, 36-200, 36-190, 36-180 or 36-170° C.

The term "light naphtha" as used herein refers to hydrocarbons boiling in the range of about 20-110, 20-100, 20-90, 20-88, 32-110, 32-100, 32-90, 32-88, 36-110, 36-100, 36-90 or 36-88° C.

The term "middle distillates" as used herein relative to effluents from the atmospheric distillation unit or flash zone refers to hydrocarbons boiling in the range of about 170-370, 170-360, 170-350, 170-340, 170-320, 180-370, 180-360, 180-350, 180-340, 180-320, 190-370, 190-360, 190-350, 190-340, 190-320, 200-370, 200-360, 200-350, 200-340, 200-320, 210-370, 210-210, 210-350, 210-340, 210-320, 220-370, 220-220, 220-350, 220-340 or 220-320° C.

The term "unconverted oil" and its acronym "UCO," is used herein having its known meaning, and refers to a highly paraffinic fraction obtained from a separation zone associated with a hydroprocessing reactor, and contains reduced nitrogen, sulfur and nickel content relative to the reactor feed, and includes in certain embodiments hydrocarbons having an initial boiling point in the range of about 340-370° C., for instance about 340, 360 or 370° C., and an end point in the range of about 510-560° C., for instance about 540, 550, 560° C. or higher depending on the characteristics of the feed to the hydroprocessing reactor, and hydroprocessing reactor design and conditions. UCO is also known in the industry by other synonyms including "hydrowax."

The term "cracked diesel" refers to a hydrocarbon fraction obtained from a separation zone associated with a hydroprocessing reactor, and contains reduced nitrogen, sulfur and nickel content relative to the reactor feed, and includes in certain embodiments hydrocarbons having an initial boiling point corresponding to the end point of the cracked naphtha fraction(s) obtained from the separation zone associated with the hydroprocessing reactor, and having an end boiling point corresponding to the initial boiling point of the unconverted oil.

FIG. 1 is a process flow diagram of an embodiment of an integrated hydrocracking unit operation, system 100 including a hydrocracking reaction zone 106, a fractionating zone 110, and an HPNA separation zone 120. Reaction zone 106 generally includes one or more inlets in fluid communication with a source of initial feedstock 102, a source of hydrogen gas 104, and the HPNA separation zone 120 to receive a recycle stream comprising all or a portion of the HPNA-reduced bottoms fraction 122. Reaction zone 106 includes an effective reactor configuration with the requisite reaction vessel(s), feed heaters, heat exchangers, hot and/or cold separators, product fractionators, strippers, and/or other units to process, and operates with effective catalyst(s) and under effective operating conditions to carry out the desired degree of treatment and conversion of the feed. One or more outlets of reaction zone 106 that discharge effluent stream 108 are in fluid communication with one or more inlets of the fractionating zone 110. In certain embodiments (not shown), effluents from the hydrocracking reaction vessels are cooled in an exchanger and sent to a high pressure hot and/or cold separator. The fractionating zone 110 includes one or more outlets for discharging a distillate fraction 114 containing cracked naphtha and cracked middle distillate/diesel products; and one or more outlets for discharging a bottoms fraction 116 containing unconverted oil. In certain embodiments, the fractionation zone 110 includes one or more outlets for discharging gases, stream 112, typically $H_2$, $H_2S$, $NH_3$, and light hydrocarbons ($C_1$-$C_4$).

The bottoms fraction 116 outlet is in fluid communication with one or more inlets of the HPNA separation zone 120. In certain embodiments one or more optional additional feeds, stream 154, are in fluid communication with one or more inlets of the HPNA separation zone 120. The HPNA separation zone 120 generally includes one or more outlets for discharging HPNA-reduced fractionator bottoms portion 122 and one or more outlets for discharging an oxidized aromatics stream 124 containing oxidized HPNA compounds and/or oxidized HPNA precursor compounds. The outlet discharging HPNA-reduced fractionator bottoms 122 is in fluid communication with one or more inlets of reaction zone 106 for recycle of all or a portion of the stream. In certain embodiments, a bleed stream 118 is drawn from bottoms 116 upstream of the HPNA separation zone 120. In additional embodiments, a bleed stream 126 is drawn from HPNA-reduced fractionator bottoms 122 downstream of the HPNA separation zone 120, in addition to or instead of bleed stream 118. Either or both of these bleed streams are hydrogen-rich and therefore can be effectively integrated with certain fuel oil pools, or serve as feed to fluidized catalytic cracking or steam cracking processes (not shown).

In operation of the system 100, a feedstock stream 102 and a hydrogen stream 104 are charged to the reaction zone 106. Hydrogen stream 104 contains an effective quantity of hydrogen to support the requisite degree of hydrocracking, feed type, and other factors, and can be any combination including make-up hydrogen, recycle hydrogen from optional gas separation subsystems (not shown) between reaction zone 106 and fractionating zone 110, and/or derived from fractionator gas stream 112. Reaction zone 106 operates under effective conditions for production of a reaction effluent stream 108 which contains converted, partially converted and unconverted hydrocarbons, including HPNA and/or HPNA precursor compounds formed in the reaction zone 106. One or more high pressure and low pressure separation stages can be integrated as is known to recover recycle hydrogen between the reaction zone 106 and fractionating zone 110. For example, effluents from the hydrocracking reaction vessel are cooled in an exchanger and sent to a high pressure hot and/or cold separator. Separator tops are cleaned in an amine unit and the resulting hydrogen rich gas stream is passed to a recycling compressor to be used as a recycle gas in the hydrocracking reaction vessel. Separator bottoms from the high pressure separator, which are in a substantially liquid phase, are cooled and then introduced to a low pressure cold separator. Remaining gases including hydrogen, $H_2S$, $NH_3$ and any light hydrocarbons, which can include $C_1$-$C_4$ hydrocarbons, can be conventionally purged from the low pressure cold separator and sent for further processing, such as flare processing or fuel gas processing. The liquid stream from the low pressure cold separator is passed to the fractionating zone 110.

The reaction effluent stream 108 is passed to fractionating zone 110, generally to recover gas stream 112 and liquid products 114 and to separate a bottoms fraction 116 containing HPNA compounds. Gas stream 112, typically containing $H_2$, $H_2S$, $NH_3$, and light hydrocarbons ($C_1$-$C_4$), is discharged and recovered and can be further processed as is known in the art, including for recovery of recycle hydrogen. In certain embodiments one or more gas streams are discharged from one or more separators between the reactor and the fractionator (not shown), and gas stream 112 can be optional from the fractionator. One or more cracked product streams 114 are discharged from appropriate outlets of the fractionator and can be further processed and/or blended in downstream refinery operations as gasoline, kerosene and/or diesel fuel products or intermediates, and/or other hydrocarbon mixtures that can be used to produce petrochemical products. In certain embodiments (not shown), fractionating zone 110 can operate as one or more flash vessels to separate heavy components at a suitable cut point, for example, a range corresponding to the upper temperature range of the desired product stream 114.

In certain embodiments, all, a major portion, a significant portion, or a substantial portion of the fractionator bottoms stream 116 derived from the reaction effluent, containing HPNA compounds and/or HPNA precursors formed in the reaction zone 106, is passed to the HPNA separation zone 120 for treatment. In certain embodiments a portion of the fractionator bottoms from the reaction effluent is removed from the recycle loop as bleed stream 118. Bleed stream 118 can contain a suitable portion (V %) of the fractionator bottoms 116, in certain embodiments about 0-10, 0-5, 0-3, 1-10, 1-5 or 1-3. The concentration of HPNA compounds and/or HPNA precursors in the hydrocracking effluent fractionator bottoms is reduced in the HPNA separation zone 120 to produce the HPNA-reduced fractionator bottoms stream 122 that is recycled to the reaction zone 106. In certain embodiments, instead of or in conjunction with bleed stream 118, a portion of the HPNA-reduced fractionator bottoms stream 122 is removed from the recycle loop as bleed stream 126. Bleed stream 126 can contain a suitable portion (V %) of the HPNA-reduced fractionator bottoms stream 122, in certain embodiments about 0-10, 0-5, 0-3, 1-10, 1-5 or 1-3. A discharge stream 124 containing HPNA compounds is removed from the HPNA separation zone 120. In certain embodiments, all, a major portion, a significant portion, or a substantial portion of the HPNA-reduced fractionator bottoms stream 122 is recycled to the reaction zone 106.

In additional embodiments, one or more optional additional feeds, stream 154 can be routed to the HPNA separation zone 120. Such additional feeds can be within a similar range as the hydrocracker bottoms stream fraction and/or the initial feedstock to the system 100, and selected from one or more of straight run vacuum gas oil, treated vacuum gas oil, demetallized oil from solvent demetallizing operations, deasphalted oil from solvent deasphalting operations, coker gas oils from coker operations, cycle oils from fluid catalytic cracking operations including heavy cycle oil, and visbroken oils from visbreaking operations, and generally has a boiling point range within about 350-800, 350-700, 350-600 or 350-565° C. For instance, the stream 154 can be in the range of about 0-100, 0-50, 10-100, 10-50, 20-100 or 20-50 V %, relative to the portion of the fractionator bottoms 116 fed to the HPNA separation zone 120. In certain embodiments the only feed to the HPNA separation zone 120 are derived from the fractionator bottoms 116.

Reaction zone 106 can contain one or more fixed-bed, ebullated-bed, slurry-bed, moving bed, continuous stirred tank (CSTR), or tubular reactors, in series and/or parallel arrangement. The reactor(s) are generally operated under conditions effective for the desired level of treatment, degree of conversion, type of reactor, the feed characteristics, and the desired product slate. In certain embodiments the reactors operate at conversion levels (V % of feed that is recovered above the unconverted oil range) in the range of 30-90, 50-90, 60-90 or 70-90. For instance, these conditions can include a reaction temperature (° C.) in the range of from about 300-500, 300-475, 300-450, 330-500, 330-475 or 330-450; a reaction pressure (bars) in the range of from about 60-300, 60-200, 60-180, 100-300, 100-200, 100-180, 130-300, 130-200 or 130-180; a hydrogen feed rate (standard liter per liter of hydrocarbon feed (SL/L)) of up to about 2500, 2000 or 1500, in certain embodiments from about 800-2500, 800-2000, 800-1500, 1000-2500, 1000-2000 or 1000-1500; and a feed rate liquid hourly space velocity ($h^{-1}$) in the range of from about 0.1-10, 0.1-5, 0.1-2, 0.25-10, 0.25-5, 0.25-2, 0.5-10, 0.5-5 or 0.5-2. Effective catalysts used in reaction zone 106 possess hydrotreating functionality (hydrodesulfurization, hydrodenitrification and/or hydrodemetallization) and hydrocracking functionality. Hydrodesulfurization, hydrodenitrification and/or hydrodemetallization is carried out to remove sulfur, nitrogen and other contaminants, and conversion of feedstocks occurs by cracking into lighter fractions, for instance, in certain embodiments at least about 30 V % conversion.

Figure 2:
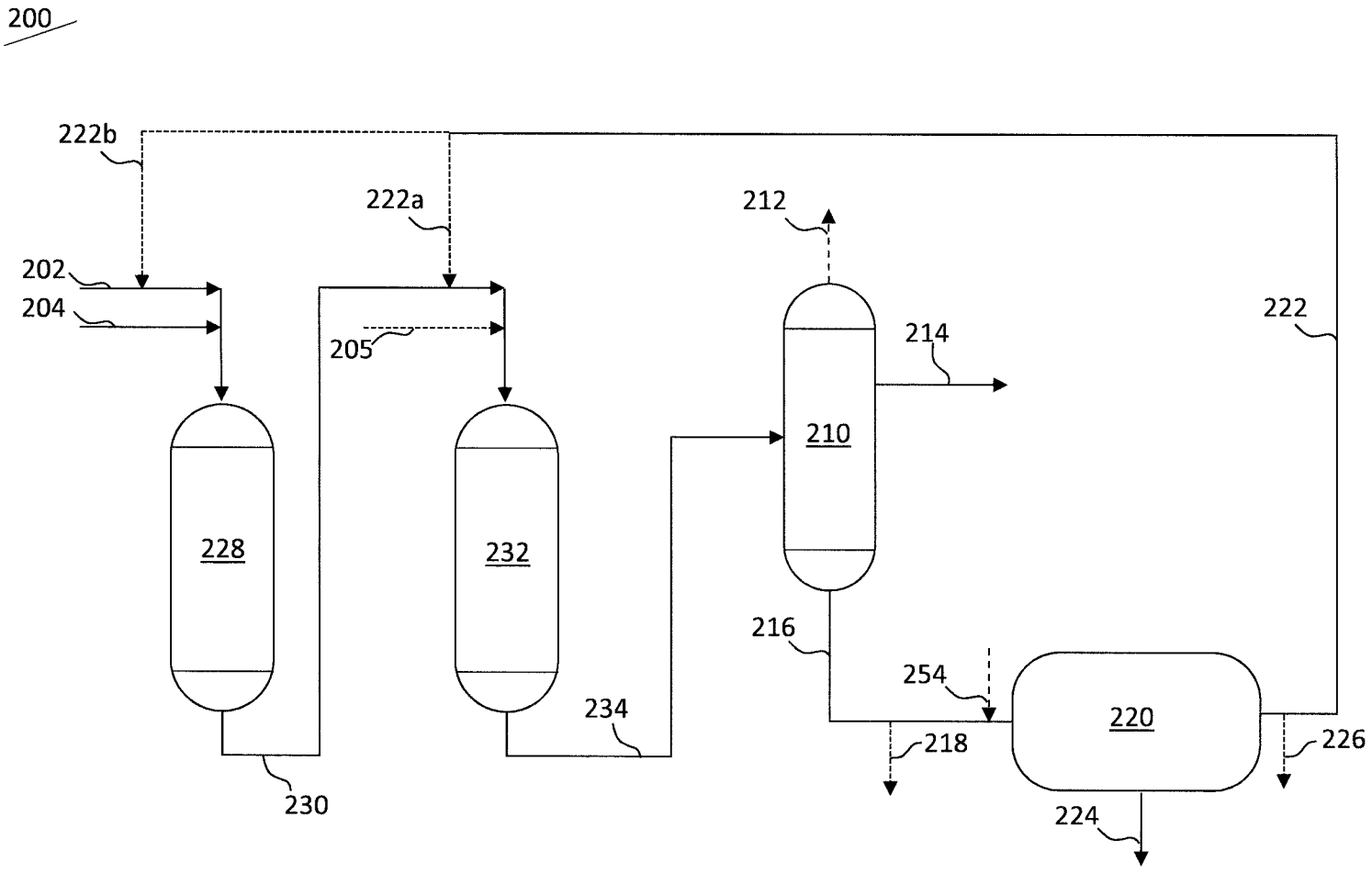
FIG. 2 is a process flow diagram of an integrated series-flow hydrocracking system.

FIG. 2 is a process flow diagram of another embodiment of an integrated hydrocracking unit operation, system 200, which operates as series-flow hydrocracking system with recycle to the first reactor zone, the second rector zone, or both the first and second reactor zones. In general, system 200 includes a first reaction zone 228, a second reaction zone 232, a fractionating zone 210, and an HPNA separation zone 220. The first reaction zone 228 generally includes one or more inlets in fluid communication with a source of initial feedstock 202, a source of hydrogen gas 204, and optionally the HPNA separation zone 220 to receive a recycle stream comprising all or a portion of the HPNA-reduced bottoms fraction 222, shown in dashed lines as stream 222*b*. The first reaction zone 228 includes an effective reactor configuration with the requisite reaction vessel(s), feed heaters, heat exchangers, hot and/or cold separators, product fractionators, strippers, and/or other units to process, and operates with effective catalyst(s) and under effective operating conditions to carry out the desired degree of treatment and conversion of the feed. One or more outlets of the first reaction zone 228 that discharge effluent stream 230 is in fluid communication with one or more inlets of the second reaction zone 232. In certain embodiments, the effluents 230 are passed to the second reaction zone 232 without separation of any excess hydrogen and light gases. In optional embodiments, one or more high pressure and low pressure separation stages are provided between the first and second reaction zones 228, 232 for recovery of recycle hydrogen (not shown). The second reaction zone 232 generally includes one or more inlets in fluid communication with one or more outlets of the first reaction zone 228, optionally a source of additional hydrogen gas 205 and optionally the HPNA separation zone 220 to receive a recycle stream comprising all or a portion of the HPNA-reduced reaction zone bottoms fraction 222, shown in dashed lines as stream 222*a*. The second reaction zone 232 includes an effective reactor configuration with the requisite reaction vessel(s), feed heaters, heat exchangers, hot and/or cold separators, product fractionators, strippers, and/or other units to process, and operates with effective catalyst(s) and under effective operating conditions to carry out the desired degree of additional conversion of the feed. One or more outlets of the second reaction zone 232 that discharge effluent stream 234 is in fluid communication with one or more inlets of the fractionating zone 210 (optionally having one or more high pressure and low pressure separation stages therebetween for recovery of recycle hydrogen, not shown). The fractionating zone 210 includes one or more outlets for discharging a distillate fraction 214 containing cracked naphtha and cracked middle distillate/diesel products and one or more outlets for discharging a bottoms fraction 216 containing unconverted oil. In certain embodiments, the fractionation zone 210 includes one or more outlets for discharging gases, stream 212, typically $H_2$, $H_2S$, $NH_3$, and light hydrocarbons ($C_1$-$C_4$).

The bottoms fraction 216 outlet is in fluid communication with one or more inlets of the HPNA separation zone 220. In certain embodiments one or more optional additional feeds, stream 254, are in fluid communication with one or more inlets of the HPNA separation zone 220. The HPNA separation zone 220 generally includes one or more outlets for discharging HPNA-reduced fractionator bottoms portion 222 and one or more outlets for discharging an oxidized aromatics stream 224 containing oxidized HPNA compounds and/or oxidized HPNA precursor compounds. The outlet discharging HPNA-reduced fractionator bottoms 222 is in fluid communication with one or more inlets of reaction zone 228 and/or 232 for recycle of all or a portion of the stream. In certain embodiments, a bleed stream 218 is drawn from bottoms 216 upstream of the HPNA separation zone 220. In additional embodiments, a bleed stream 226 is drawn from HPNA-reduced fractionator bottoms 222 downstream of the HPNA separation zone 220, in addition to or instead of bleed stream 218. Either or both of these bleed streams are hydrogen-rich and therefore can be effectively integrated with certain fuel oil pools, or serve as feed to fluidized catalytic cracking or steam cracking processes (not shown).

In operation of the system 200, a feedstock stream 202 and a hydrogen stream 204 are charged to the first reaction zone 228. Hydrogen stream 204 includes an effective quantity of hydrogen to support the requisite degree of hydrocracking, feed type, and other factors, and can be any combination including make-up hydrogen, recycle hydrogen from optional gas separation subsystems (not shown) between reaction zones 228 and 232, recycle hydrogen from optional gas separation subsystems (not shown) between reaction zone 232 and fractionator 210, and/or derived from fractionator gas stream 212. The first reaction zone 228 operates under effective conditions for production of reaction effluent stream 230 (optionally after one or more high pressure and low pressure separation stages to recover recycle hydrogen) which is passed to the second reaction zone 232, optionally along with an additional hydrogen stream 205. The second reaction zone 232 operates under conditions effective for production of the reaction effluent stream 234, which contains converted, partially converted and unconverted hydrocarbons. The reaction effluent stream further includes HPNA compounds that were formed in the reaction zones 228 and/or 232. One or more high pressure and low pressure separation stages can be integrated as is known to recover recycle hydrogen between the reaction zone 228 and the reaction zone 232, and/or between the reaction zone 232 and fractionating zone 210. For example, effluents from the hydrocracking reaction zones 228 and/or 232 are cooled in an exchanger and sent to a high pressure hot and/or cold separator. Separator tops are cleaned in an amine unit and the resulting hydrogen rich gas stream is passed to a recycling compressor to be used as a recycle gas in the hydrocracking reaction vessel. Separator bottoms from the high pressure separator, which are in a substantially liquid phase, are cooled and then introduced to a low pressure cold separator. Remaining gases including hydrogen, $H_2S$, $NH_3$ and any light hydrocarbons, which can include $C_1$-$C_4$ hydrocarbons, can be conventionally purged from the low pressure cold separator and sent for further processing, such as flare processing or fuel gas processing. The liquid stream from the low pressure cold separator is passed to the next stage, that is, the second reactor 232 or the fractionating zone 210.

The reaction effluent stream 234 is passed to the fractionation zone 210, generally to recover gas stream 212 and liquid products 214 and to separate a bottoms fraction 216 containing HPNA compounds. Gas stream 212, typically containing $H_2$, $H_2S$, $NH_3$, and light hydrocarbons ($C_1$-$C_4$), is discharged and recovered and can be further processed as is known in the art, including for recovery of recycle hydrogen. In certain embodiments one or more gas streams are discharged from one or more separators between the reactors, or between the reactor and the fractionator (not shown), and gas stream 212 can be optional from the fractionator. One or more cracked product streams 214 are discharged from appropriate outlets of the fractionator and can be further processed and/or blended in downstream refinery operations as gasoline, kerosene and/or diesel fuel products or intermediates, and/or other hydrocarbon mixtures that can be used to produce petrochemical products. In certain embodiments (not shown), fractionating zone 210 can operate as one or more flash vessels to separate heavy components at a suitable cut point, for example, a range corresponding to the upper temperature range of the desired product stream 214.

In certain embodiments, all, a major portion, a significant portion, or a substantial portion of the fractionator bottoms stream 216, containing HPNA compounds and/or HPNA precursors formed in the reaction zones, is passed to the HPNA separation zone 220 for treatment. In certain embodiments a portion of the fractionator bottoms from the reaction effluent is removed from the recycle loop as bleed stream 218. Bleed stream 218 can contain a suitable portion (V %) of the fractionator bottoms 216, in certain embodiments about 0-10, 0-5, 0-3, 1-10, 1-5 or 1-3. The concentration of HPNA compounds and/or HPNA precursors in the fractionator bottoms is reduced in the HPNA separation zone 220 to produce the HPNA-reduced fractionator bottoms stream 222. A discharge stream 224 containing HPNA compounds and/or HPNA precursors is removed from the HPNA separation zone 220. In certain embodiments, instead of or in conjunction with bleed stream 218, a portion of the HPNA-reduced fractionator bottoms stream 222 is removed from the recycle loop as bleed stream 226. Bleed stream 226 can contain a suitable portion (V %) of the HPNA-reduced fractionator bottoms stream 222, in certain embodiments about 0-10, 0-5, 0-3, 1-10, 1-5 or 1-3. In certain embodiments, all or a portion of the HPNA-reduced fractionator bottoms stream 222 is recycled to the second reaction zone 232 as stream **222*a*, the first reaction zone 228 as stream 222*b*, or both the first and second reaction zones 228 and 232. For instance, stream 222*b* comprises (V %) 0-100, 0-80 or 0-50 relative to stream 222 that is recycled to zone 228, and stream 222*a* comprises 0-100, 0-80 or 0-50 relative to stream 222 that is recycled to zone 232. In certain embodiments, all, a major portion, a significant portion, or a substantial portion of the HPNA-reduced fractionator bottoms 222 is recycled to the first reaction zone 228 as stream 222*b***.

In additional embodiments, one or more optional additional feeds, stream 254 can be routed to the HPNA separation zone 220. Such additional feeds can be within a similar range as the hydrocracked bottoms fraction and/or the initial feedstock to the system 200, and selected from one or more of straight run vacuum gas oil, treated vacuum gas oil, demetallized oil from solvent demetallizing operations, deasphalted oil from solvent deasphalting operations, coker gas oils from coker operations, cycle oils from fluid catalytic cracking operations including heavy cycle oil, and visbroken oils from visbreaking operations, and generally has a boiling point in the range of from about 350-800, 350-700, 350-600 or 350-565° C. For instance, the stream 254 can be in the range of about 0-100, 0-50, 10-100, 10-50, 20-100 or 20-50 V %, relative to the portion of the fractionator bottoms 216 fed to the HPNA separation zone 220. In certain embodiments the only feed to the HPNA separation zone 220 are derived from the fractionator bottoms 216.

The first reaction zone 228 can contain one or more fixed-bed, ebullated-bed, slurry-bed, moving bed, CSTR, or tubular reactors, in series and/or parallel arrangement. The reactor(s) are generally operated under conditions effective for the desired level of treatment and degree of conversion in the first reaction zone 228, the particular type of reactor, the feed characteristics, and the desired product slate. For instance, these conditions can include a reaction temperature (° C.) in the range of from about 300-500, 300-475, 300-450, 330-500, 330-475 or 330-450; a reaction pressure (bars) in the range of from about 60-300, 60-200, 60-180, 100-300, 100-200, 100-180, 130-300, 130-200 or 130-180; a hydrogen feed rate (SL/L) of up to about 2500, 2000 or 1500, in certain embodiments from about 800-2500, 800-2000, 800-1500, 1000-2500, 1000-2000 or 1000-1500; and a feed rate liquid hourly space velocity ($h^{-1}$) in the range of from about 0.1-10, 0.1-5, 0.1-2, 0.25-10, 0.25-5, 0.25-2, 0.5-10, 0.5-5 or 0.5-2. The catalyst used in the first reaction zone 228 can comprise those having hydrotreating functionality, and in certain embodiments those having hydrotreating and hydrocracking functionality. In embodiments in which catalysts used in first reaction zone 228 possess hydrotreating functionality, including hydrodesulfurization, hydrodenitrification and/or hydrodemetallization, the focus is removal of sulfur, nitrogen and other contaminants, with a limited degree of conversion (for instance in the range of 10-30 V %). In embodiments in which catalysts used in first reaction zone 228 possess hydrotreating and hydrocracking functionality, a higher degree of conversion, generally above about 30 V %, occurs.

The second reaction zone 232 can contain one or more fixed-bed, ebullated-bed, slurry-bed, moving bed, CSTR, or tubular reactors, in series and/or parallel arrangement. The reactor(s) are generally operated under conditions effective for the desired degree of conversion, particular type of reactor, the feed characteristics, and the desired product slate. For instance, these conditions can include a reaction temperature (° C.) in the range of from about 300-500, 300-475, 300-450, 330-500, 330-475 or 330-450; a reaction pressure (bars) in the range of from about 60-300, 60-200, 60-180, 100-300, 100-200, 100-180, 130-300, 130-200 or 130-180; a hydrogen feed rate (SL/L) of up to about 2500, 2000 or 1500, in certain embodiments from about 800-2500, 800-2000, 800-1500, 1000-2500, 1000-2000 or 1000-1500; and a feed rate liquid hourly space velocity ($h^{-1}$) in the range of from about 0.1-10, 0.1-5, 0.1-2, 0.25-10, 0.25-5, 0.25-2, 0.5-10, 0.5-5 or 0.5-2. The catalyst used in the second reaction zone 232 can comprise those having hydrocracking functionality, and in certain embodiments those having hydrocracking and hydrogenation functionality.

Figure 3:
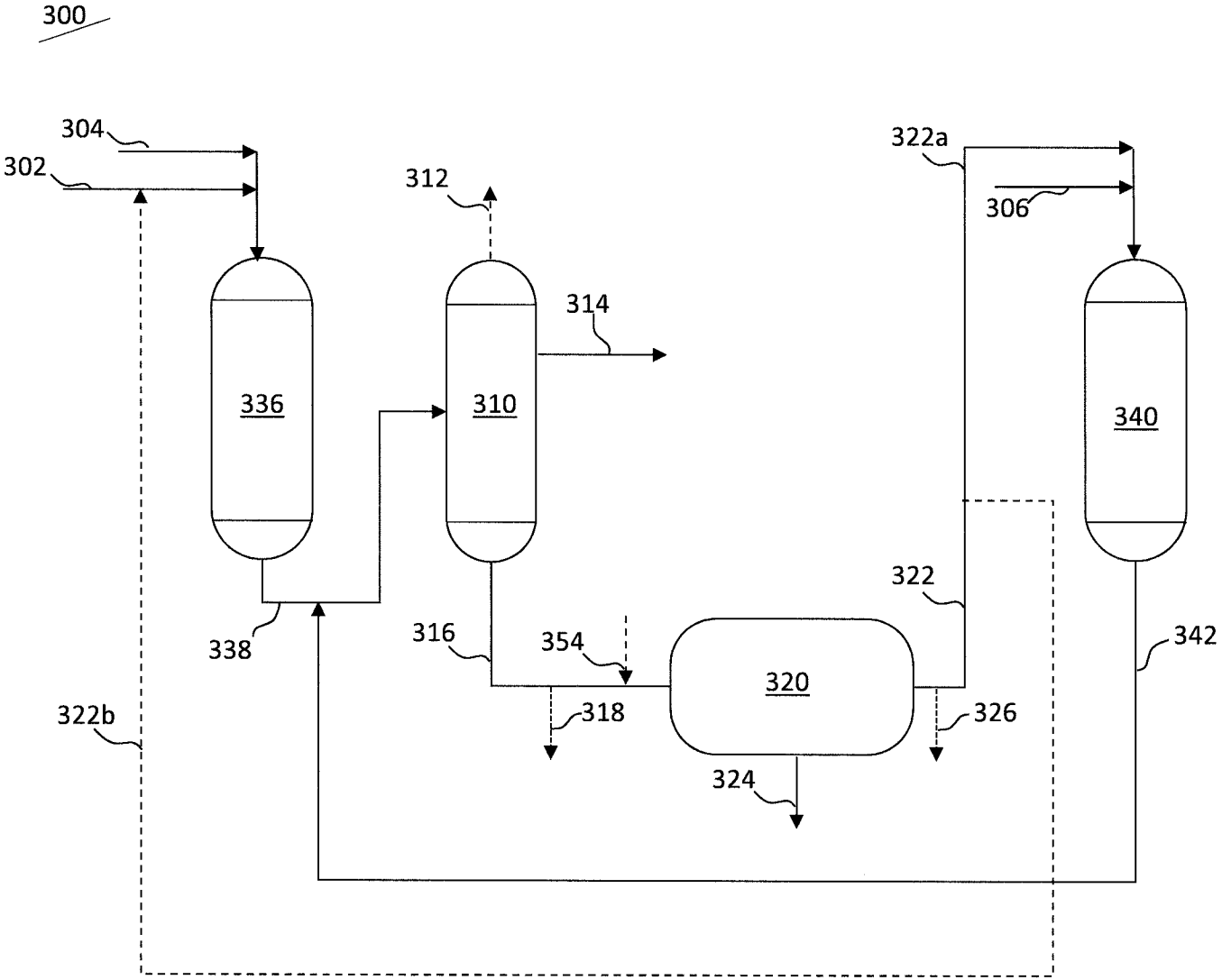
FIG. 3 is a process flow diagram of an integrated two-stage hydrocracking system with recycle.

FIG. 3 is a process flow diagram of another embodiment of an integrated hydrocracking unit operation, system 300, which operates as two-stage hydrocracking system with recycle. In general, system 300 includes a first reaction zone 336, a second reaction zone 340, a fractionating zone 310, and an HPNA separation zone 320. The first reaction zone 336 generally includes one or more inlets in fluid communication with a source of initial feedstock 302 and a source of hydrogen gas 304. The first reaction zone 336 includes an effective reactor configuration with the requisite reaction vessel(s), feed heaters, heat exchangers, hot and/or cold separators, product fractionators, strippers, and/or other units to process, and operates with effective catalyst(s) and under effective operating conditions to carry out the desired degree of treatment and conversion of the feed. One or more outlets of the first reaction zone 336 that discharge effluent stream 338 is in fluid communication with one or more inlets of the fractionating zone 310 (optionally having one or more high pressure and low pressure separation stages therebetween for recovery of recycle hydrogen, not shown). The fractionating zone 310 includes one or more outlets for discharging a distillate fraction 314 containing cracked naphtha and cracked middle distillate/diesel products; and one or more outlets for discharging a bottoms fraction 316 containing unconverted oil. In certain embodiments, the fractionation zone 310 includes one or more outlets for discharging gases, stream 312, typically Hz, $H_2S$, $NH_3$, and light hydrocarbons ($C_1$-$C_4$). The second reaction zone 340 generally includes one or more inlets in fluid communication with one or more outlets of the HPNA separation zone 320 for receiving an HPNA-reduced fractionator bottoms stream 322*a* and a source of hydrogen gas 306. The second reaction zone 340 includes an effective reactor configuration with the requisite reaction vessel(s), feed heaters, heat exchangers, hot and/or cold separators, product fractionators, strippers, and/or other units to process, and operates with effective catalyst(s) and under effective operating conditions to carry out the desired degree of additional conversion of the feed. One or more outlets of the second reaction zone 340 that discharge effluent stream 342 are in fluid communication with one or more inlets of the fractionating zone 310 (optionally having one or more high pressure and low pressure separation stages for recovery of recycle hydrogen, not shown).

The bottoms fraction 316 outlet is in fluid communication with one or more inlets of the HPNA separation zone 320. In certain embodiments one or more optional additional feeds, stream 354, are in fluid communication with one or more inlets of the HPNA separation zone 320. The HPNA separation zone 320 generally includes one or more outlets for discharging HPNA-reduced fractionator bottoms 322 and one or more outlets for discharging a oxidized aromatics stream 324 containing oxidized HPNA compounds and/or oxidized HPNA precursor compounds. The outlet discharging HPNA-reduced fractionator bottoms 322 is in fluid communication with one or more inlets of the second reaction zone 340 for recycle of all or a portion 322*a* of the recycle stream 322. In certain optional embodiments, a portion 322*b*, shown in dashed lines, is in fluid communication with one or more inlets of the first reaction zone 336. In certain embodiments, a bleed stream 318 is drawn from bottoms 316 upstream of the HPNA separation zone 320. In additional embodiments, a bleed stream 326 is drawn from HPNA-reduced fractionator bottoms 322 downstream of the HPNA separation zone 320, in addition to or instead of bleed stream 318. Either or both of these bleed streams are hydrogen-rich and therefore can be effectively integrated with certain fuel oil pools, or serve as feed to fluidized catalytic cracking or steam cracking processes (not shown).

In operation of the system 300, a feedstock stream 302 and a hydrogen stream 304 are charged to the first reaction zone 336. Hydrogen stream 304 includes an effective quantity of hydrogen to support the requisite degree of hydrocracking, feed type, and other factors, and can be any combination including make-up hydrogen, recycle hydrogen from optional gas separation subsystems (not shown) between first reaction zone 336 and fractionating zone 310, recycle hydrogen from optional gas separation subsystems (not shown) between second reaction zone 340 and fractionating zone 310, and/or derived from fractionator gas stream 312. The first reaction zone 336 operates under effective conditions for production of reaction effluent stream 338. The reaction effluent stream further includes HPNA compounds that were formed in the reaction zone 336. One or more high pressure and low pressure separation stages can be integrated as is known to recover recycle hydrogen between the reaction zone 336 and the fractionating zone 310. For example, effluents from the hydrocracking reaction vessel are cooled in an exchanger and sent to a high pressure hot and/or cold separator. Separator tops are cleaned in an amine unit and the resulting hydrogen rich gas stream is passed to a recycling compressor to be used as a recycle gas in the hydrocracking reaction vessel. Separator bottoms from the high pressure separator, which are in a substantially liquid phase, are cooled and then introduced to a low pressure cold separator. Remaining gases including hydrogen, $H_2S$, $NH_3$ and any light hydrocarbons, which can include $C_1$-$C_4$ hydrocarbons, can be conventionally purged from the low pressure cold separator and sent for further processing, such as flare processing or fuel gas processing. The liquid stream from the low pressure cold separator is passed to the fractionating zone 310.

The reaction effluent stream 338 is passed to the fractionation zone 310, generally to recover gas stream 312 and liquid products 314 and to separate a bottoms fraction 316 containing HPNA compounds. Gas stream 312, typically containing $H_2$, $H_2S$, $NH_3$, and light hydrocarbons ($C_1$-$C_4$), is discharged and recovered and can be further processed as is known in the art, including for recovery of recycle hydrogen. In certain embodiments one or more gas streams are discharged from one or more separators between the reactors (not shown), or between the reactor and the fractionator, and gas stream 312 can be optional from the fractionator. One or more cracked product streams 314 are discharged from appropriate outlets of the fractionator and can be further processed and/or blended in downstream refinery operations as gasoline, kerosene and/or diesel fuel products or intermediates, and/or other hydrocarbon mixtures that can be used to produce petrochemical products. In certain embodiments (not shown), fractionating zone 310 can operate as one or more flash vessels to separate heavy components at a suitable cut point, for example, a range corresponding to the upper temperature range of the desired product stream 314.

In certain embodiments, all, a major portion, a significant portion, or a substantial portion of the fractionator bottoms stream 316 containing HPNA compounds and/or HPNA precursors formed in the reaction zones is passed to the HPNA separation zone 320 for treatment. In certain embodiments a portion of the fractionator bottoms from the reaction effluent is removed as bleed stream 318. Bleed stream 318 can contain a suitable portion (V %) of the fractionator bottoms 316, in certain embodiments about 0-10, 0-5, 0-3, 1-10, 1-5 or 1-3. The concentration of HPNA compounds and/or HPNA precursors in the fractionator bottoms is reduced in the HPNA separation zone 320 to produce the HPNA-reduced fractionator bottoms stream 322. A discharge stream 324 containing HPNA compounds is removed from the HPNA separation zone 320. In certain embodiments, instead of or in conjunction with bleed stream 318, a portion of the HPNA-reduced fractionator bottoms stream 322 is removed from the recycle loop as bleed stream 326. Bleed stream 326 can contain a suitable portion (V %) of the HPNA-reduced fractionator bottoms stream 322, in certain embodiments about 0-10, 0-5, 0-3, 1-10, 1-5 or 1-3. In certain embodiments, or a portion of the HPNA-reduced fractionator bottoms stream 322 is passed to the second reaction zone 340 as stream 322*a*. In certain embodiments, all or a portion of the HPNA-reduced fractionator bottoms stream 322 is recycled to the second reaction zone 340 as stream 322*a*, the first reaction zone 336 as stream 322*b*, or both the first and second reaction zones 336 and 340. For instance, stream 322*a* comprises (V %) 0-100, 0-80 or 0-50 relative to stream 322 that is recycled to zone 340, and stream 322*b* comprises 0-100, 0-80 or 0-50 relative to stream 322 that is recycled to zone 336. In certain embodiments, all, a major portion, a significant portion, or a substantial portion of the HPNA-reduced fractionator bottoms 322 is passed to the second reaction zone 340 as stream 322*a*. The second reaction zone 340 operates under conditions effective for production of the reaction effluent stream 342, which contains converted, partially converted and unconverted hydrocarbons. The second stage the reaction effluent stream 342 is passed to the fractionating zone 310, optionally through one or more gas separators to recovery recycle hydrogen and remove certain light gases.

In additional embodiments, one or more optional additional feeds, stream 354 can be routed to the HPNA separation zone 320. Such additional feeds can be within a similar range as the hydrocracked bottoms fraction and/or the initial feedstock to the system 300, and selected from one or more of straight run vacuum gas oil, treated vacuum gas oil, demetallized oil from solvent demetallizing operations, deasphalted oil from solvent deasphalting operations, coker gas oils from coker operations, cycle oils from fluid catalytic cracking operations including heavy cycle oil, and visbroken oils from visbreaking operations, and generally has a boiling point in the range within about 350-800, 350-700, 350-600 or 350-565° C. For instance, the stream 354 can be in the range of about 0-100, 0-50, 10-100, 10-50, 20-100 or 20-50 V %, relative to the portion of the fractionator bottoms 316 fed to the HPNA separation zone 320. In certain embodiments the only feed to the HPNA separation zone 320 are derived from the fractionator bottoms 316.

The first reaction zone 336 can contain one or more fixed-bed, ebullated-bed, slurry-bed, moving bed, CSTR, or tubular reactors, in series and/or parallel arrangement. The reactor(s) are generally operated under conditions effective for the desired level of treatment and degree of conversion in the first reaction zone 336, the particular type of reactor, the feed characteristics, and the desired product slate. For instance, these conditions can include a reaction temperature (° C.) in the range of from about 300-500, 300-475, 300-450, 330-500, 330-475 or 330-450; a reaction pressure (bars) in the range of from about 60-300, 60-200, 60-180, 100-300, 100-200, 100-180, 130-300, 130-200 or 130-180; a hydrogen feed rate (SL/L) of up to about 2500, 2000 or 1500, in certain embodiments from about 800-2500, 800-2000, 800-1500, 1000-2500, 1000-2000 or 1000-1500; and a feed rate liquid hourly space velocity ($h^{-1}$) in the range of from about 0.1-10, 0.1-5, 0.1-2, 0.25-10, 0.25-5, 0.25-2, 0.5-10, 0.5-5 or 0.5-2. The catalyst used in the first reaction zone 336 can comprise those having hydrotreating functionality, and in certain embodiments those having hydrotreating and hydrocracking functionality. In embodiments in which catalysts used in first reaction zone 336 possess hydrotreating functionality, including hydrodesulfurization, hydrodenitrification and/or hydrodemetallization, the focus is removal of sulfur, nitrogen and other contaminants, with a limited degree of conversion (for instance in the range of 10-30 V %). In embodiments in which catalysts used in first reaction zone 336 possess hydrotreating and hydrocracking functionality, a higher degree of conversion occurs, generally above about 30 V %, for instance in the range of about 30-60 V %.

The second reaction zone 340 can contain one or more fixed-bed, ebullated-bed, slurry-bed, moving bed, CSTR, or tubular reactors, in series and/or parallel arrangement. The reactor(s) are generally operated under conditions effective for the desired degree of conversion, particular type of reactor, the feed characteristics, and the desired product slate. For instance, these conditions can include a reaction temperature (° C.) in the range of from about 300-500, 300-475, 300-450, 330-500, 330-475 or 330-450; a reaction pressure (bars) in the range of from about 60-300, 60-200, 60-180, 100-300, 100-200, 100-180, 130-300, 130-200 or 130-180; a hydrogen feed rate (SL/L) of up to about 2500, 2000 or 1500, in certain embodiments from about 800-2500, 800-2000, 800-1500, 1000-2500, 1000-2000 or 1000-1500; and a feed rate liquid hourly space velocity ($h^{-1}$) in the range of from about 0.1-10, 0.1-5, 0.1-2, 0.25-10, 0.25-5, 0.25-2, 0.5-10, 0.5-5 or 0.5-2. The catalyst used in the second reaction zone 340 can comprise those having hydrocracking functionality for further conversion of refined and partially cracked components from the feedstock, and in certain embodiments those having hydrocracking and hydrogenation functionality.

Effective catalysts used in embodiments in which those possessing hydrotreating functionality required, for instance, in first reaction zone 228 or first reaction zone 336, are known. Such hydrotreating catalysts, sometimes referred to in the industry as "pretreat catalyst," are effective for hydrotreating, and inherently a limited degree of conversion occurs (generally below about 30 V %). The catalysts generally contain one or more active metal components of metals or metal compounds (oxides or sulfides) selected from the Periodic Table of the Elements IUPAC Groups 6, 7, 8, 9 and 10. One or more active metal component(s) are typically deposited or otherwise incorporated on a support, which can be amorphous and/or structured, such as alumina, silica-alumina, silica, titania, titania-silica or titania-silicates. Combinations of active metal components can be composed of different particles/granules containing a single active metal species, or particles containing multiple active species. For example, effective hydrotreating catalysts include one or more of an active metal component selected from the group consisting of cobalt, nickel, tungsten, molybdenum (oxides or sulfides), incorporated on an alumina support, typically with other additives. In certain embodiments in which an objective is hydrodenitrification and treatment of difficult feedstocks such as demetallized oil, the supports are acidic alumina, silica alumina or a combination thereof. In embodiments in which the objective is hydrodenitrification increases hydrocarbon conversion, the supports are silica alumina, or a combination thereof. Silica alumina is useful for difficult feedstocks for stability and enhanced cracking. In certain embodiments, the catalyst particles have a pore volume in the range of about (cc/gm) 0.15-1.70, 0.15-1.50, 0.30-1.50 or 0.30-1.70; a specific surface area in the range of about ($m^2/g$) 100-400, 100-350, 100-300, 150-400, 150-350, 150-300, 200-400, 200-350 or 200-300; and an average pore diameter of at least about 10, 50, 100, 200, 500 or 1000 angstrom units. The active metal component(s) are incorporated in an effective concentration, for instance, in the range of (wt % based on the mass of the oxides, sulfides or metals relative to the total mass of the catalysts) 1-40, 1-30, 1-10, 1-5, 2-40, 2-30, 2-10, 3-40, 3-30 or 3-10. In certain embodiments, the active metal component (s) include one or more of cobalt, nickel, tungsten and molybdenum, and effective concentrations are based on all the mass of active metal components on an oxide basis. In certain embodiments, hydrotreating catalysts are configured in one or more beds selected from nickel/tungsten/molybdenum, cobalt/molybdenum, nickel/molybdenum, nickel/tungsten, and cobalt/nickel/molybdenum. Combinations of one or more beds of nickel/tungsten/molybdenum, cobalt/molybdenum, nickel/molybdenum, nickel/tungsten and cobalt/nickel/molybdenum, are useful for difficult feedstocks such as demetallized oil, and to increase hydrocracking functionality. In additional embodiments, the catalyst includes a bed of cobalt/molybdenum catalysts and a bed of nickel/molybdenum catalysts.

Effective catalysts used in embodiments where those possessing hydrotreating and hydrocracking functionality are required, for instance, reaction zone 106, first reaction zone 228 or first reaction zone 336, are known. These catalysts, effective for hydrotreating and a degree of conversion generally in the range of about 30-60 V %. contain one or more active metal components of metals or metal compounds (oxides or sulfides) selected from the Periodic Table of the Elements IUPAC Groups 6, 7, 8, 9 and 10. One or more active metal component(s) are typically deposited or otherwise incorporated on a support, which can be amorphous and/or structured, such as alumina, silica-alumina, silica, titania, titania-silica, titania-silicates, or zeolites. Combinations of active metal components can be composed of different particles/granules containing a single active metal species, or particles containing multiple active species. For example, effective hydrotreating/hydrocracking catalysts include one or more of an active metal component selected from the group consisting of cobalt, nickel, tungsten, molybdenum (oxides or sulfides), incorporated on acidic alumina, silica alumina, zeolite or a combination thereof. In embodiments in which zeolites are used, they are conventionally formed with one or more binder components such as alumina, silica, silica-alumina and mixtures thereof. In certain embodiments in which an objective is hydrodenitrification and treatment of difficult feedstocks such as demetallized oil, the supports are acidic alumina, silica alumina or a combination thereof. In embodiments in which the objective is hydrodenitrification increases hydrocarbon conversion, the supports are silica alumina, or a combination thereof. Silica alumina is useful for difficult feedstocks for stability and enhanced cracking. In certain embodiments, the catalyst particles have a pore volume in the range of about (cc/gm) 0.15-1.70, 0.15-1.50, 0.30-1.50 or 0.30-1.70; a specific surface area in the range of about ($m^2/g$) 100-900, 100-500, 100-450, 180-900, 180-500, 180-450, 200-900, 200-500 or 200-450; and an average pore diameter of at least about 45, 50, 100, 200, 500 or 1000 angstrom units. The active metal component(s) are incorporated in an effective concentration, for instance, in the range of (wt % based on the mass of the oxides, sulfides or metals relative to the total mass of the catalysts) 1-40, 1-30, 1-10, 1-5, 2-40, 2-30, 2-10, 3-40, 3-30 or 3-10. In certain embodiments, the active metal component(s) include one or more of cobalt, nickel, tungsten and molybdenum, and effective concentrations are based on all the mass of active metal components on an oxide basis. In certain embodiments, one or more beds are provided in series in a single reactor or in a series of reactors. For instance, a first catalyst bed containing active metals on silica alumina support is provided for hydrodenitrogenation, hydrodesulfurization and hydrocracking functionalities, followed by a catalyst bed containing active metals on zeolite support for hydrocracking functionality.

Effective catalysts used in embodiments where those possessing hydro cracking functionality, for instance, second reaction zone 232 or second reaction zone 340, are known. These catalysts, effective for further conversion of refined and partially cracked components from the feedstock, contain one or more active metal components of metals or metal compounds (oxides or sulfides) selected from the Periodic Table of the Elements IUPAC Groups 6, 7, 8, 9 and 10. One or more active metal component(s) are typically deposited or otherwise incorporated on a support, which can be amorphous and/or structured, such as silica-alumina, silica, titania, titania-silica, titania-silicates, or zeolites. Combinations of active metal components can be composed of different particles/granules containing a single active metal species, or particles containing multiple active species. In embodiments in which zeolites are used, they are conventionally formed with one or more binder components such as alumina, silica, silica-alumina and mixtures thereof. For example, effective hydrocracking catalysts include one or more of an active metal component selected from the group consisting of nickel, tungsten, molybdenum (oxides or sulfides), incorporated on acidic alumina, silica alumina, zeolite or a combination thereof. In certain embodiments, the catalyst particles have a pore volume in the range of about (cc/gm) 0.15-1.70, 0.15-1.50, 0.30-1.50 or 0.30-1.70; a specific surface area in the range of about ($m^2/g$) 100-900, 100-500, 100-450, 180-900, 180-500, 180-450, 200-900, 200-500 or 200-450; and an average pore diameter of at least about 45, 50, 100, 200, 500 or 1000 angstrom units. The active metal component(s) are incorporated in an effective concentration, for instance, in the range of (wt % based on the mass of the oxides, sulfides or metals relative to the total mass of the catalysts) 1-40, 1-30, 1-10, 1-5, 2-40, 2-30, 2-10, 3-40, 3-30 or 3-10. In certain embodiments, the active metal component(s) include one or more of cobalt, nickel, tungsten and molybdenum, and effective concentrations are based on all the mass of active metal components on an oxide basis. In a typical hydrocracking reaction scheme, the main cracking catalyst bed or beds are followed by post treat catalyst to remove mercaptans formed during hydrocracking. Typical supports for post treat catalyst are silica-alumina, zeolites of combination thereof.

Effective catalysts used in embodiments where those possessing hydrocracking and hydrogenation functionality, for instance, second reaction zone 232 or second reaction zone 340, are known. These catalysts, effective for further conversion and also for hydrogenation of refined and partially cracked components from the feedstock, contain one or more active metal components of metals or metal compounds (oxides or sulfides) selected from the Periodic Table of the Elements IUPAC Groups 6, 7, 8, 9 and 10. One or more active metal component(s) are typically deposited or otherwise incorporated on a support, which can be amorphous and/or structured, such as alumina, silica-alumina, silica, titania, titania-silica, titania-silicates, or zeolites. Combinations of active metal components can be composed of different particles/granules containing a single active metal species, or particles containing multiple active species. For example, effective hydrocracking catalysts include one or more of an active metal component selected from the group consisting of cobalt, nickel, tungsten, molybdenum (oxides), incorporated on acidic alumina, silica alumina, zeolite or a combination thereof. In certain embodiments, the catalyst particles have a pore volume in the range of about (cc/gm) 0.15-1.70, 0.15-1.50, 0.30-1.50 or 0.30-1.70; a specific surface area in the range of about ($m^2/g$) 100-900, 100-800, 100-500, 100-450, 180-900, 180-800, 180-500, 180-450, 200-900, 200-800, 200-500 or 200-450; and an average pore diameter of at least about 45, 50, 100, 200, 500 or 1000 angstrom units. The active metal component(s) are incorporated in an effective concentration, for instance, in the range of (wt % based on the mass of the oxides, sulfides or metals relative to the total mass of the catalyst) 0.01-40, 0.01-30, 0.01-10, 0.01-5, 1-40, 1-30, 1-10, 1-5, 2-40, 2-30, 2-10, 3-40, 3-30 or 3-10. In certain embodiments, the active metal component(s) include one or more of cobalt, nickel, tungsten and molybdenum, and effective concentrations are based on all the mass of active metal components on an oxide basis. In embodiments in which one or more upstream reaction zone(s) reduces contaminants such as sulfur and nitrogen, so that hydrogen sulfide and ammonia are minimized in the reaction zone, active metal components effective as hydrogenation catalysts can include one or more noble metals such as platinum, palladium or rhodium, alone or in combination with other active metals such as nickel. Such noble metals can be provided in the range of (wt % based on the mass of the metal relative to the total mass of the catalyst) 0.01-5, 0.01-2, 0.05-5, 0.05-2, 0.1-5, 0.1-2, 0.5-5, or 0.5-2.

In certain embodiments, the catalyst and/or the catalyst support is prepared in accordance with U.S. Pat. No. 9,221,036 and related U.S. Pat. No. 10,081,009 (jointly owned by the owner of the present application), which are incorporated herein by reference in their entireties, includes a modified USY zeolite support having one or more of Ti, Zr and/or Hf substituting the aluminum atoms constituting the zeolite framework thereof.

In embodiments described herein using zeolite-based hydrocracking catalysts, HPNA compounds have relatively greater tendency to accumulate in the recycle stream due to the inability for these larger molecules to diffuse into the catalyst pore structure, particularly at relatively lower hydrogen partial pressure levels in the reactor. For instance, at hydrogen partial pressures less than about 100 bars, HPNA formation is known to reduce catalyst lifecycle to by 30-70% depending upon the feedstock processed and targeted conversion rate. However, according to the process herein, by removing HPNA compounds from the recycle stream, the lifecycle of such zeolite catalyst is increased.

The HPNA separation zones 120, 220 and 320 integrated in hydrocracking systems 100, 200 and 300 described herein, and variations thereto apparent to a person having ordinary skill in the art, are effective for removal of HPNA compounds and/or HPNA precursor compounds from a hydrocracker bottoms stream. The hydrocracker bottoms fraction contains HPNA compounds and/or HPNA precursor compounds that were formed in the reaction zones, and are treated in the HPNA separation zone to produce the reduced-HPNA hydrocracked bottoms fraction. In certain embodiments, a major portion, a significant portion, or a substantial portion of HPNA compounds are removed from the hydrocracker bottoms stream by contact with an oxidation agent followed by separation of oxidized aromatics from the remaining hydrocarbons.

In accordance with the various embodiments herein, hydrocracked bottoms fractions containing HPNA compounds and/or HPNA precursor compounds are contacted with an effective quantity of oxidation agent and optionally an effective quantity of catalyst under reaction conditions suitable to oxidize HPNA compounds and/or HPNA precursor compounds and form an oxidized hydrocracked bottoms fraction. The bottoms fraction is mostly naphthenic and paraffinic, and in operation of the process herein, aromatics are selectively oxidized in the presence of catalysts. While some quantity of other hydrocarbons may be oxidized during the oxidation step, the impact of the process yield is minimized. Such oxidized hydrocarbons are readily hydrogenated and/or deoxygenated in the hydrocracking reactors as they are recycled.

The oxidized hydrocracked bottoms fraction containing aromatic oxides can be separated into an HPNA-reduced hydrocracked bottoms portion and an oxidized HPNA portion by aqueous phase separation and/or liquid-liquid solvent extraction. It was observed that in one embodiment of the process herein, oxidized HPNA compounds were present in the separated aqueous phase, and the reduced HPNA recycle stream did not contain HPNA compounds, based upon Fourier transform mass spectrometry data described further herein.

In certain embodiments, the oxidized hydrocracked bottoms fraction can be separated into an HPNA-reduced hydrocracked bottoms fraction and an oxidized HPNA portion using one of the separation methods described below, such as an aqueous separation process, a solvent extraction process that rejects the oxidized HPNA portion based on polarity, or a solvent extraction process based on aromatic selectively. In additional embodiments, the oxidized hydrocracked bottoms fraction can be separated into an HPNA-reduced hydrocracked bottoms fraction and an oxidized HPNA portion using two or more of the separation methods described herein, for instance, an aqueous separation process followed by a solvent extraction HPNA separation process based on polarity or aromatic selectively. In certain embodiments, the oxidized hydrocracked bottoms fraction can be separated into an HPNA-reduced hydrocracked bottoms fraction and an oxidized HPNA portion using an aqueous separation process followed by a solvent extraction HPNA separation process based on polarity.

Figure 4:
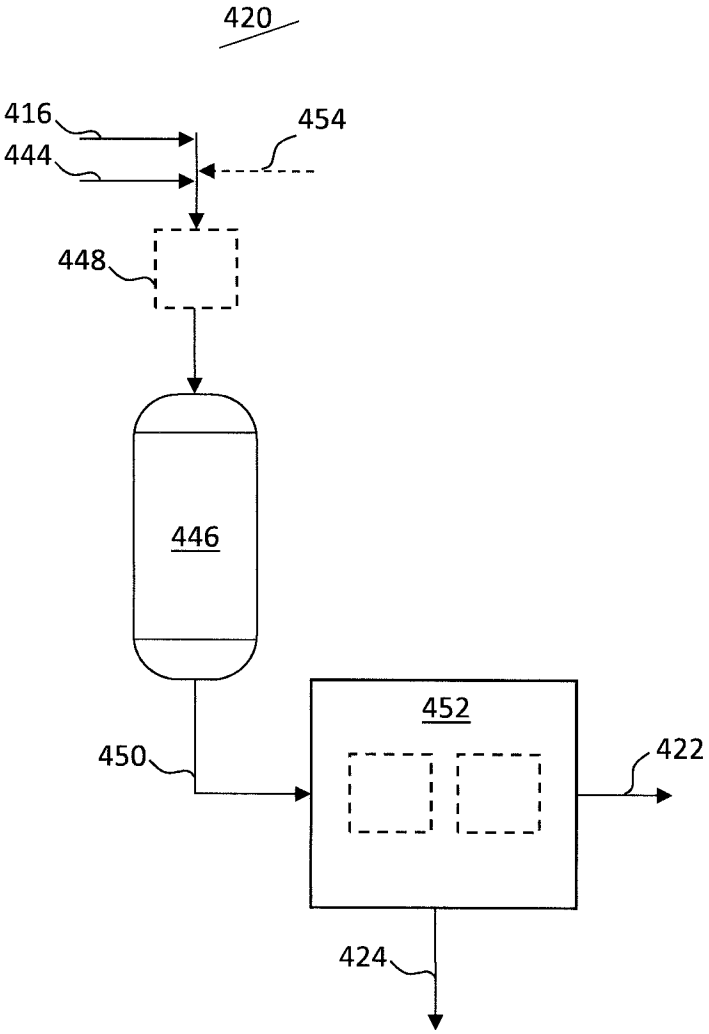
FIG. 4 is a process flow diagram of an embodiment of oxidation and separation of HPNA compounds from a hydrocracker bottoms stream, generally showing removal of oxidized HPNA compounds.

Referring to FIG. 4, a method for separation of HPNA compounds and/or HPNA precursor compounds from a hydrocracked bottoms fraction is shown. A hydrocracked bottoms fraction is contacted with an oxidation agent and optionally an effective quantity of catalyst under reaction conditions suitable to oxidize HPNA and/or HPNA precursor compounds to produce corresponding aromatic oxides and form an oxidized hydrocracked bottoms fraction. The oxidized hydrocracked bottoms fraction is separated into an HPNA-reduced hydrocracked bottoms fraction and an oxidized HPNA portion.

An HPNA separation zone 420 generally includes an oxidation reaction zone 446 and a separation zone 452. The oxidation reaction zone 446 includes one or more inlets for receiving a feed comprising or consisting of a hydrocracked bottoms fraction 416 (for instance corresponding to all, a substantial portion, a significant portion, or a major portion of streams 116, 216 or 316 above) containing HPNA compounds, and one or more inlets for receiving a source of oxidation agent 444. In certain embodiments, an optional feed 454 is also charged to the oxidation reaction zone 446, which can be one or more feedstreams similar to feeds to the hydrocracking operation, or can be a portion of the feed to the hydrocracking operation, for instance, similar to streams 154, 254 and 354 described above. A contacting and/or mixing zone 448 is optionally included upstream of reaction zone 446 to promote intimate mixing of oil, oxidation agent, and optionally catalyst.

Reaction products 450, which include aromatic oxides formed in the reaction zone 446 including oxidized HPNA compounds and/or oxidized HPNA precursor compounds, other oxidized hydrocarbons, and the remaining hydrocarbons, are phase separated in a separation zone 452. Separation zone generally includes one or more aqueous phase separation and/or liquid-liquid solvent extraction steps in series and/or parallel arrangement. In certain embodiments, separation zone 452 includes liquid-liquid solvent extraction followed by aqueous phase separation. Liquid-liquid solvent extraction operations can be carried out in one or more settler vessels, a stage-type extractor such as a mixer-settler apparatus or a centrifugal contactor, or a differential extractor including but not limited to multiple stage centrifugal contactors or contacting columns such as tray columns, spray columns, packed towers, rotating disc contactors or pulse columns. The solvent extraction operations typically include one or more flash vessels arranged to recover and recycle solvent.

An HPNA-reduced hydrocracked bottoms fraction is discharged as effluent 422 (for instance corresponding to streams 122, 222 or 322 above), and an oxidized aromatics stream containing HPNA is discharged as stream 424 (for instance corresponding to streams 124, 224 or 324 above).

Reaction zone 446 can contain one or more suitable reactors such as fixed-bed, ebullated-bed, slurry-bed, moving bed, continuous stirred tank, or tubular reactors, and/or one or more suitable liquid-liquid contactor columns, tray columns, spray columns, packed towers, rotating disc contactors, pulse columns, in series and/or parallel arrangement. The reactor(s) are generally operated under conditions effective for the particular type of reactor, the feed characteristics, and the desired conversion, and to promote reaction with aromatics to produce a reaction product mixture containing oxidized aromatic including oxidized HPNA compounds.

Effective operating conditions in processes using liquid phase oxidant can include a reaction temperature (° C.). in the range of from about 0-150, 0-100, 0-80, 20-150, 20-100 or 20-80;

a reaction pressure (bars) in the range of from about 1-30, 1-10 or 1-5;

an oxidation agent to aromatic carbon containing compounds (molar ratio) of from about 1:1-15:1, 1:1-10:1, 1:1-5:1, 4:1-15:1, 4:1-10:1, or 4:1-5:1; and a feed rate liquid hourly space velocity based on the volume of the reactor ($h^{-1}$) in the range of from about 0.5-20, 0.5-10, 0.5-5, 1-20, 1-10 or 1-5.

Effective operating conditions in processes using gas phase oxidant can include a reaction temperature (° C.). in the range of from about 20-600, 150-600, 20-550, 150-550, 20-500, 150-500, 200-600, 200-550, 200-500, 300-600, 300-550 or 300-550;

a reaction pressure (bars) in the range of from about 0.01 (vacuum)-100, 0.01-50, 0.01-30, 0.01-5, 0.35 (vacuum)-100, 0.35-50, 0.35-30, 0.35-5, 1-100, 1-50, 1-30 or 1-5;

an oxidation agent to aromatic carbon containing compounds (molar ratio) of from about 1:1-15:1, 1:1-10:1, 1:1-5:1, 4:1-15:1, 4:1-10:1, or 4:1-5:1; and a feed rate gas hourly space velocity based on the volume of the reactor ($h^{-1}$) in the range of from about 0.5-20, 0.5-10, 0.5-5, 1-20, 1-10 or 1-5.

The source 444 provides an effective concentration of oxidation agent. The oxidation agent can be a liquid phase oxidant selected from the group consisting of peroxides, hydroperoxides, organic peracids, and combinations thereof. In additional embodiments, gas phase oxidant is used, for instance, selected from the group consisting of air, oxygen, oxides of nitrogen, ozone, $SO_2$, $SO_3$ and combinations thereof. Other aspects of gas phase oxidation are described herein with respect to FIGS. 13A, 13B and 13C. Oxidation reactions can occur in the presence or absence of catalysts such as metal oxide having the formula MxOy, wherein M is an element selected from the Periodic Table of the Elements IUPAC Groups 4, 5 and 6. In embodiments using liquid phase oxidant, effective catalysts include sodium tungstate and molybdenum acetylacetonate. In embodiments using gas phase oxidant, effective catalysts include Cu—Zn/Al type catalysts, and those or modified Mo, W, and/or B. In addition, one or more co-catalysts or phase transfer agents can be included, such as acetic acid. In certain embodiments phase transfer agents are provided to facilitate the biphasic reaction, including a quaternary ammonium halide.

Figure 5:
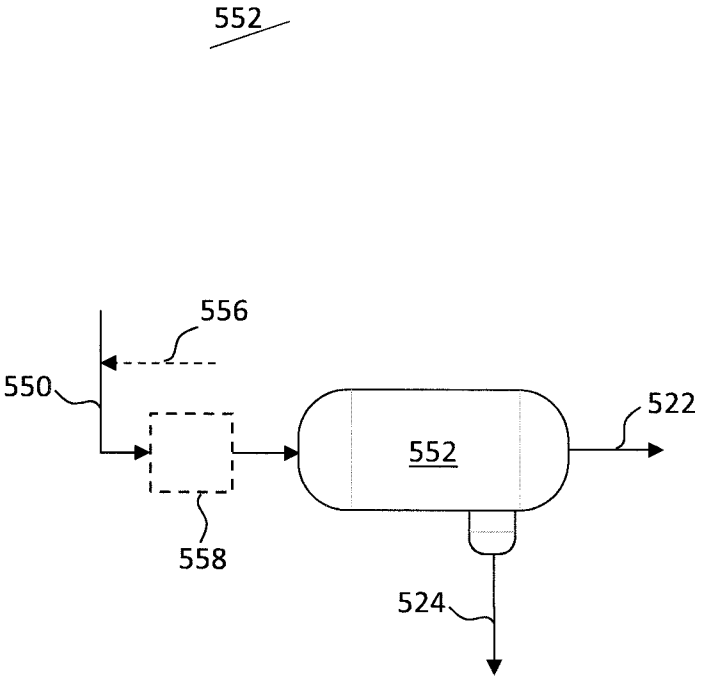
FIG. 5 is a process flow diagram of an embodiment of oxidation and separation of HPNA compounds from a hydrocracker bottoms, showing removal of oxidized HPNA compounds by aqueous separation.

Referring to FIG. 5, a method for separation of HPNA from a hydrocracked bottoms fraction is shown. A hydrocracked bottoms fraction is contacted with an effective quantity oxidation agent and optionally an effective quantity of catalyst under reaction conditions suitable to oxidize HPNA and/or HPNA precursor aromatic compounds, as described above with respect to reaction zone 446. Corresponding aromatic oxides are produced, and an oxidized hydrocracked bottoms fraction is formed. The oxidized hydrocracked bottoms fraction is separated into an HPNA-reduced hydrocracked bottoms fraction and an oxidized HPNA portion. The oxidized hydrocracked bottoms fraction contains and/or is mixed with an effective quantity of aqueous solvent, such as water, to dissolve aromatic oxides and form an oil phase containing the HPNA-reduced recycle stream and an aqueous phase containing dissolved aromatic oxides. The oil and aqueous phases are phase separated to recover an HPNA-reduced hydrocracked bottoms fraction and an aqueous phase stream containing dissolved aromatic oxides.

In one embodiment, reaction products 550, which include oxides formed in the oxidation reaction zone including oxidized HPNA compounds, other oxidized hydrocarbons, and the remaining hydrocarbons, are phase separated in a separation zone 552. An HPNA-reduced hydrocracked bottoms fraction is discharged as effluent 522 (for instance corresponding to streams 122, 222 or 322 above), and an oxidized aromatics stream containing HPNA compounds is discharged as stream 524 (for instance corresponding to streams 124, 224 or 324 above). Separation zone 552 can contain one or more suitable separation operations in series and/or parallel arrangement effective for aqueous-oil phase separation. In additional embodiments, an optional mixing zone 558 can be included upstream of the separation zone 552.

In embodiments in which there is sufficient water in the reaction products 550, the mixture can be sent to the separation zone 552, optionally via the mixing zone 558, without additional water. For instance in certain embodiments the oxidation agent is an aqueous liquid oxidant, such as a hydrogen peroxide solution, with sufficient water for phase separation. In embodiments in which the oxidant is gaseous or non-aqueous, or in embodiments operating with liquid oxidation agent and where additional water is need, an effective quantity of water or additional water 556 can be added to the reaction product 550 to dissolve the oxidized HPNA and/or oxidized HPNA precursor compounds. Note that the water or additional water 556 can be added to the reaction product 550 as shown, to the separation zone 552, and/or to the optional mixing zone 558. For instance, an effective quantity of additional water can be up to about 50, 30, 20, 10 or 5 V % relative to the oil volume, and as low as about 1 V % or even lower since HPNA concentrations are relatively low. The quantity of water can be added so that the total water content is equivalent to the content of the oxidized HPNA and/or HPNA precursor compounds in the reaction product 550. In certain embodiments, for instance where a peroxide oxidant is used such as hydrogen peroxide, water produced during oxidation also serves as the quantity of water used for separation, alone or in combination with water from an initial aqueous oxidant solution and/or with additional water. Excess water is often used, and is removed as necessary after separation.

In aqueous-oil phase separation, the reaction product 550 is maintained in one or more two phase liquid separator vessels under conditions effective for the aqueous phase 524 containing oxidized HPNA compounds to separate from the oil phase 522 containing an HPNA-reduced hydrocracked bottoms fraction. For instance, these conditions can include a vessel temperature (° C.). in the range of from about 20-150, 20-75, 20-60, 30-150, 30-75, 30-60, 45-150, 45-75 or 45-60; a vessel pressure (bars) in the range of from about 1-10, 1-5 or 1-3; and residence time (minutes) in the range of from about 1-100, 1-60, 1-30, 15-100, 15-60 or 15-30. In certain embodiments, some unreacted HPNA and/or HPNA precursor compounds pass with aqueous phase stream 524 and/or the oil phase stream 522, and some of the oxidized HPNA and/or HPNA precursor compounds, for instance no more than a minor portion, pass with the oil phase 522. Any water remaining in the oil phase stream 522 can be removed as is known prior to recycling, or in certain embodiments prior to further separation of oxidized HPNA and/or HPNA precursor compounds, for instance by solvent extraction. In addition, any oil remaining in the aqueous phase stream 524 can be removed and recovered as is known, for instance prior to recycling or treatment.

In one effective configuration for HPNA reduction, a CSTR reactor is provided using liquid phase aqueous hydrogen peroxide as the oxidant, acetic acid as phase transfer reagent or co-catalyst, and sodium tungstate as the catalyst, operating at a liquid hourly space velocity of about 0.3-8 $h^{-1}$, a temperature of about 70-90° C., and a pressure of about 0.35-5 bar.

Figure 6:
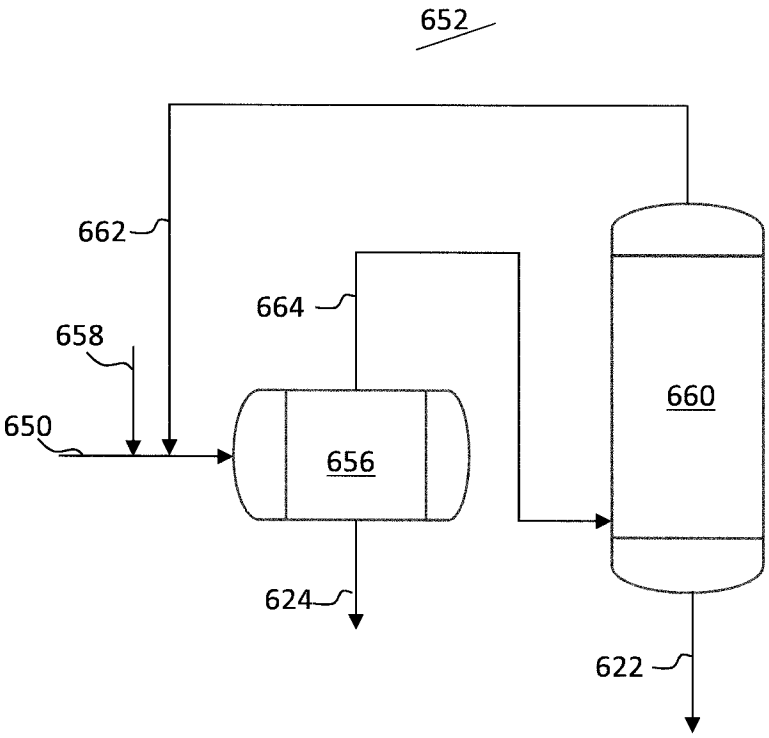
FIGS. 6 and 7 are is a process flow diagrams of additional embodiments of oxidation and separation of HPNA compounds from a hydrocracker bottoms, in which removal of oxidized HPNA compounds is carried by solvent extraction operations in one or more settler vessels.

Referring to FIG. 6, a method for separation of HPNA from a hydrocracked bottoms fraction is shown using solvent extraction based on polarity. A hydrocracked bottoms fraction is contacted with an oxidation agent and optionally an effective quantity of catalyst under reaction conditions suitable to oxidize HPNA compounds and form an oxidized hydrocracked bottoms fraction. The oxidation reaction step is similar to that shown and described with respect to FIG. 4, to produce an oxidized hydrocracked bottoms fraction 650. The oxidized hydrocracked bottoms fraction 650 is separated into an HPNA-reduced hydrocracked bottoms fraction 622 and an oxidized HPNA portion 624 using a solvent extraction process. In certain embodiments, the solvent extraction process operates using a non-polar solvent.

Reaction products 650, which include oxides formed in an oxidation reaction zone including oxidized HPNA compounds, other oxidized hydrocarbons, and the remaining hydrocarbons, are subjected to liquid-liquid solvent extraction with a non-polar solvent to reject the polar oxidized HPNA and HPNA precursor compounds in a separation zone 652. An HPNA-reduced hydrocracked bottoms fraction is discharged as effluent 622 (for instance corresponding to streams 122, 222 or 322 above), and an oxidized aromatics stream containing HPNA is discharged as stream 624 (for instance corresponding to streams 124, 224 or 324 above).

Separation zone 652 generally includes a settler 656 and a flash separation zone 660. Settler 656 includes an inlet for receiving oxidized hydrocracked bottoms fraction 650 and solvent, which can be fresh solvent 658, recycle solvent stream 662, or a combination of these solvent sources. Settler 656 also includes one or more outlets for discharging a soluble phase 664 containing HPNA-reduced hydrocracked bottoms and solvent, and one or more outlets for discharging oxidized HPNA compounds as the insoluble precipitate phase 624. Flash separation zone 660 includes an inlet for receiving the soluble phase 664, one or more outlets for discharging a solvent stream 662 and one or more outlets for discharging an HPNA-reduced hydrocracked bottoms stream 622 (for instance corresponding to streams 122, 222 or 322 above).

The oxidized hydrocracked bottoms fraction 650 is admixed with non-polar solvent from one or more sources 658 and/or 662. The resulting mixture is then transferred to the settler 656. By mixing and settling, two phases are formed in the settler 656, a soluble phase 664 containing the non-polar solvent and soluble compounds from the mixture, and a precipitated oxidized HPNA phase 624. The temperature of the settler 656 is sufficiently low to recover the soluble phase 664 from the feedstock. For instance, for a system using n-butane, a suitable temperature range is about 60° C. to 150° C. and a suitable pressure range is such that it is higher than the vapor pressure of n-butane at the operating temperature, such as about 15 to 25 bars to maintain the solvent in liquid phase. For example, in a system using n-pentane, a suitable temperature range is about 60° C. to about 180° C. and a suitable pressure range is such that it is higher than the vapor pressure of n-pentane at the operating temperature, such as about 10 to 25 bars to maintain the solvent in liquid phase.

The soluble phase 664 including a majority of solvent and non-oxidized content of the mixture, and is discharged via the outlet of the primary settler 656 and collector pipes (not shown). The oxidized HPNA phase 624 is discharged via one or more outlets located at the bottom of the settler 656. The soluble phase 664 is passed to the flash separation zone 660 to obtain a solvent stream 662 and an HPNA-reduced hydrocracked bottoms stream 622. Solvent streams 662 can be used as solvent for the settler 656, therefore minimizing the fresh solvent 658 requirement. In certain embodiments, some unreacted HPNA and/or HPNA precursor compounds pass with the precipitated oxidized HPNA stream 624, and/or the reduced HPNA stream 622, and some of the oxidized HPNA and/or HPNA precursor compounds, for instance no more than a minor portion, pass with the reduced HPNA stream 622.

Figure 7:
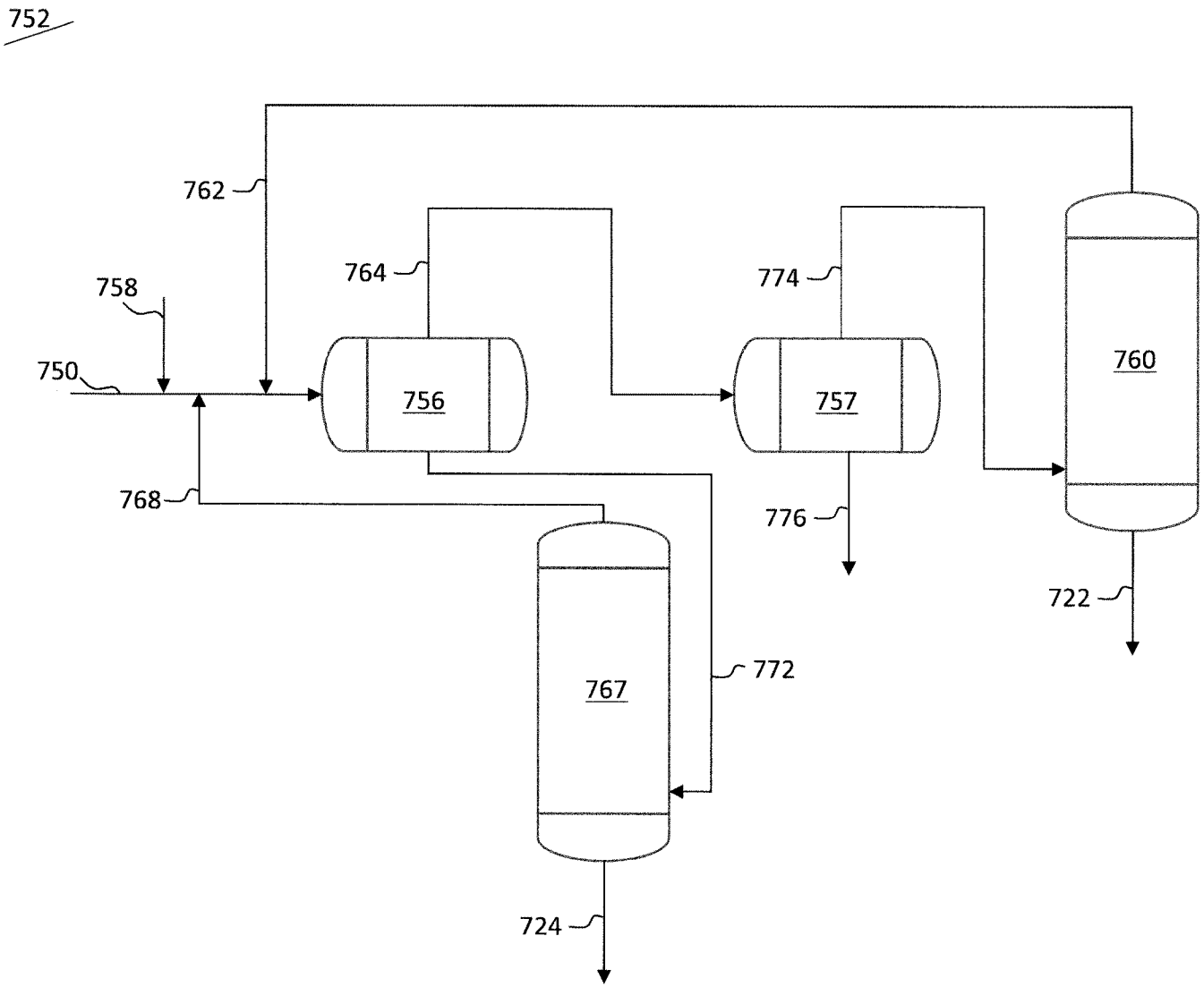

Referring to FIG. 7, another method for separation of HPNA from a hydrocracked bottoms fraction is shown, including a two stage solvent separation process. Reaction products 750, which include oxides formed in an oxidation reaction zone including oxidized HPNA compounds, other oxidized hydrocarbons, and the remaining hydrocarbons, are subjected to liquid-liquid solvent extraction in a separation zone 752. An HPNA-reduced hydrocracked bottoms fraction is discharged as effluent 722 (for instance corresponding to streams 122, 222 or 322 above), an oxidized aromatics stream containing HPNA is discharged as stream 724 (for instance corresponding to streams 124, 224 or 324 above), and a secondary HPNA phase is discharged as stream 776.

Separation zone 752 generally includes a primary settler 756, a secondary settler 757, a first flash separation zone 767, and a second flash separation zone 760. Primary settler 756 includes an inlet for receiving oxidized hydrocracked bottoms fraction 750 and a solvent, which can be fresh solvent 758, a first separation zone recycle solvent stream 768, a second separation zone recycle solvent stream 762, or a combination of these solvent sources. Primary settler 756 also includes one or more outlets for discharging a soluble phase 764 and one or more outlets for discharging oxidized HPNA compounds as the insoluble precipitate phase 772. Secondary settler 757 includes an inlet for receiving the soluble phase 764, one or more outlets for discharging a secondary reduced HPNA oil phase 774, and one or more outlets for discharging a secondary HPNA phase 776. First separation zone 767 includes a vessel having an inlet for receiving primary HPNA phase 772, one or more outlets for discharging a solvent stream 768 and one or more outlets for discharging an HPNA phase 724 (for instance corresponding to streams 124, 224 or 324 above). Second separation zone 760 includes a vessel having an inlet for receiving secondary oil phase 774, one or more outlets for discharging a solvent stream 762, and one or more outlets for discharging an HPNA-reduced hydrocracked bottoms stream 722 (for instance corresponding to streams 122, 222 or 322 above).

The oxidized hydrocracked bottoms fraction 750 is admixed with solvent from one or more sources 758, 768 and 762. The resulting mixture is then transferred to the primary settler 756. By mixing and settling, two phases are formed in the primary settler 756: a primary soluble phase 764 containing the non-polar solvent and soluble compounds from the mixture, and a primary HPNA phase 772. The temperature of the primary settler 756 is sufficiently low to recover the soluble phase 764 from the feedstock. For instance, for a system using n-butane, a suitable temperature range is about 60° C. to 150° C. and a suitable pressure range is such that it is higher than the vapor pressure of n-butane at the operating temperature, such as about 15 to 25 bars to maintain the solvent in liquid phase. In a system using n-pentane, a suitable temperature range is about 60° C. to about 180° C. and a suitable pressure range is such that it is higher than the vapor pressure of n-pentane at the operating temperature, such as about 10 to 25 bars to maintain the solvent in liquid phase. The temperature in the second settler is usually higher than the one in the first settler.

The primary soluble phase 764 including a majority of solvent and oil with a minor amount of HPNA is discharged via the outlet of the primary settler 756 and collector pipes (not shown). The primary soluble phase 764 enters into the secondary settler 757 (for example via two tee-type distributors at both ends, not shown) which serves as the final stage for the extraction. A secondary HPNA phase 776 containing a small amount of solvent and oil is discharged from the secondary settler 757 and can optionally be recycled (not shown) to the primary settler 756 for further oil recovery. A secondary soluble phase 774 is obtained and passed to the flash separation zone 760 to obtain a solvent stream 762 and a reduced HPNA recycle oil stream 722. Greater than 90 wt % of the solvent charged to the settlers enters flash separation zone 760, which is dimensioned to permit a rapid and efficient flash separation of solvent from the oil. The primary HPNA phase 772 is conveyed to the flash separation zone 767 for flash separation of a solvent stream 768 and an HPNA phase 724. Solvent streams 762 and 768 can be used as solvent for the primary settler 756, therefore minimizing the fresh solvent 758 requirement. In certain embodiments, some unreacted HPNA and/or HPNA precursor compounds pass with the precipitated oxidized HPNA stream 724, and/or the reduced HPNA stream 722, and some of the oxidized HPNA and/or HPNA precursor compounds, for instance no more than a minor portion, pass with the reduced HPNA stream 722.

The solvents used in separation zone 652, 752 can be suitable non-polar solvents effective to facilitate precipitation of the oxidized HPNA and/or HPNA precursor compounds. The non-polar solvent, or solvents, if more than one is employed, preferably have an overall Hildebrand solubility parameter of less than about 8.0 $cal^{1/2}$ $cm^{-3/2}$ or the complexing solubility parameter of less than 0.5 $(cal/cc)^{1/2}$ and a field force parameter of less than 7.5 $(cal/cc)^{1/2}$. Suitable non-polar solvents include, for example, saturated aliphatic hydrocarbons such as pentanes, hexanes, heptanes, $C_5$-$C_{11}$ paraffins and/or naphthenes, paraffinic $C_5$-$C_{11}$ naphthas, paraffinic $C_{12}$-$C_{15}$ kerosene, paraffinic $C_{16}$-$C_{20}$ diesel, normal and branched paraffins, mixtures of any of these solvents. In certain embodiments the solvents are $C_5$-$C_7$ paraffins, $C_5$-$C_7$ naphthenes, and $C_5$-$C_{11}$ paraffinic naphthas. In some embodiments, the non-polar solvent is selected from a paraffinic solvent having the formula $C_nH_{2n+2}$ (where n=3 to 10). Certain non-polar solvents are paraffinic solvents such as those having between 3 and 7 carbon atoms, include pure liquid hydrocarbons such as propane, butanes and pentanes, as well as their mixtures; these are known and commonly used in, for example, solvent deasphalting processes. In certain embodiments, all, a substantial portion, a significant portion, or a major portion of the fresh solvent 458, 558 used is obtained from a light naphtha fraction derived from the distillate fraction 114, 214 or 314, from a distillation unit upstream of the hydrocracker zone, or from another source. The operating conditions for the settler vessels include a temperature at or below the critical point of the non-polar solvent; a solvent-to-oil ratio (V/V) in the range of from about 2:1-50:1, 2:1-30:1, 2:1-15:1, 5:1-50:1, 5:1-30:1 or 5:1-15:1; and a pressure in a range that is effective to maintain the solvent/feed mixture in the liquid state in the vessel(s).

The essentially solvent-free oil stream is optionally steam stripped (not shown) to remove solvent and recycled in a single-stage or series-flow hydrocracker system, or conveyed to a second reactor in a two-stage system, as described above with respect to FIGS. 1-3.

In certain embodiments, oxidized HPNA and/or HPNA precursor compounds are separated from the oxidation reactor effluent by selective aromatic extraction. For instance, aromatic separation apparatus can be a suitable solvent extraction separation apparatus capable of partitioning the oxidized hydrocracked bottoms fraction into a reduced HPNA feed for recycle or further hydrocracking from the raffinate phase, and an oxidized HPNA byproduct from the extract phase. As is known, some unreacted HPNA and/or HPNA precursor compounds passing with the raffinate and/or extract, and some of the oxidized HPNA and/or HPNA precursor compounds, for instance no more than a minor portion, pass with the reduced HPNA stream derived from the raffinate.

The solvent, operating conditions, and the mechanism of contacting the solvent and feed permit control over the level of aromatic extraction. For instance, suitable aromatic selective solvents include furfural, N-methyl-2-pyrrolidone, dimethylformamide, dimethylsulfoxide, phenol, nitrobenzene, sulfolanes, acetonitrile, furfural, or glycols and can be provided in a solvent to oil ratio of about 20:1, in certain embodiments about 4:1, and in further embodiments about 1:1. Suitable glycols include diethylene glycol, ethylene glycol, triethylene glycol, tetraethylene glycol and dipropylene glycol. The extraction solvent can be a pure glycol or a glycol diluted with from about 2 to 10 W % water. Suitable sulfolanes include hydrocarbon-substituted sulfolanes (e.g., 3-methyl sulfolane), hydroxy sulfolanes (e.g., 3-sulfolanol and 3-methyl-4-sulfolanol), sulfolanyl ethers (e.g., methyl-3-sulfolanyl ether), and sulfolanyl esters (e.g., 3-sulfolanyl acetate). The aromatic extraction vessels can operate at a temperature in the range of from about 20° C. to 200° C., and in certain embodiments from about 40° C. to 80° C. The operating pressure of the aromatic separation apparatus can be in the range of from about 1 bar to 10 bars, and in certain embodiments from about 1 bar to 3 bars. Types of extraction vessels useful as the aromatic separation apparatus in certain embodiments of the system and process described herein include stage-type extractors or differential extractors.

Figure 8:
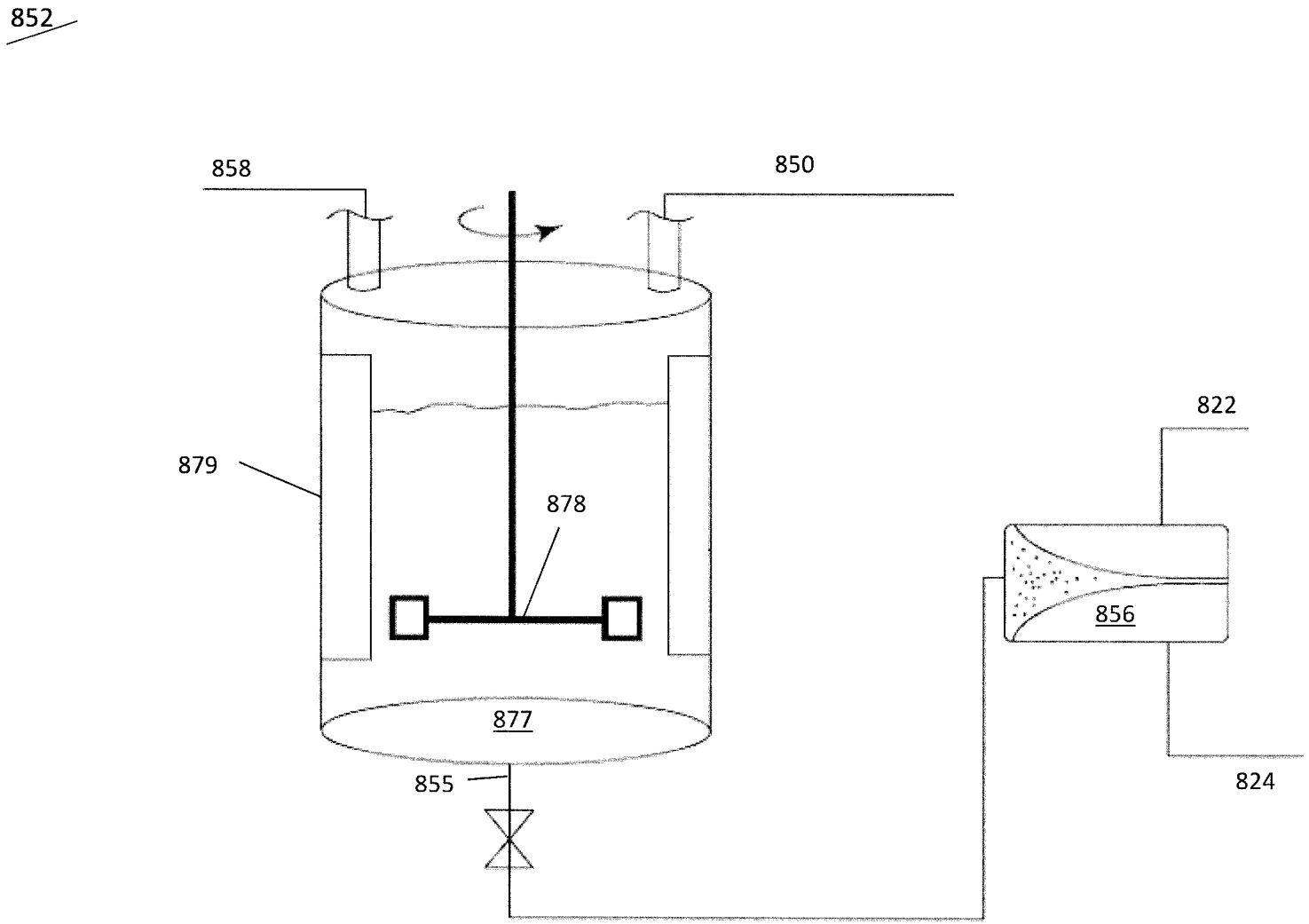
FIGS. 8-11, 12A and 12B are schematic diagrams of additional embodiments of liquid-liquid solvent extraction processes for removing oxidized HPNA compounds.

An example of a stage-type extractor is a mixer-settler apparatus 852 schematically illustrated in FIG. 8. Mixer-settler apparatus 852 includes a vertical tank 877 incorporating a turbine or a propeller agitator 878 and one or more baffles 879. Charging inlets 850, 858 are located at the top of tank 877 and outlet 855 is located at the bottom of tank 877. The bottoms fraction to be extracted and recycled is charged into vessel 877 via inlet 850 and a suitable quantity of solvent is added via inlet 858. The agitator 878 is activated for a period of time sufficient to cause intimate mixing of the solvent and charge stock, and at the conclusion of a mixing cycle, agitation is halted and, for instance, by control of a valve, at least a portion of the contents are discharged and passed to a settler 856. The phases separate in the settler 856. A raffinate phase containing reduced HPNA recycle stream is withdrawn via an outlet 824, and an extract phase containing an oxidized HPNA by-products stream is removed via an outlet 822. In general, a mixer-settler apparatus can be used in batch mode, or a plurality of mixer-settler apparatus can be staged to operate in a continuous mode.

Another stage-type extractor is a centrifugal contactor. Centrifugal contactors are high-speed, rotary machines characterized by relatively low residence time. The number of stages in a centrifugal device is usually one; however, centrifugal contactors with multiple stages can also be used. Centrifugal contactors utilize mechanical devices to agitate the mixture to increase the interfacial area and decrease the mass transfer resistance.

Various types of differential extractors (also known as "continuous contact extractors,") that are also suitable for use as an extraction apparatus include, but are not limited to, multiple stage centrifugal contactors and contacting columns such as tray columns, spray columns, packed towers, rotating disc contactors and pulse columns.

Contacting columns are suitable for various liquid-liquid extraction operations. Packing, trays, spray or other droplet-formation mechanisms or other apparatus are used to increase the surface area in which the two liquid phases (i.e., a solvent phase and a hydrocarbon phase) contact, which also increases the effective length of the flow path. In column extractors, the phase with the lower viscosity is typically selected as the continuous phase, which, in the case of an aromatic extraction apparatus, is the solvent phase. In certain embodiments, the phase with the higher flow rate can be dispersed to create more interfacial area and turbulence. This is accomplished by selecting an appropriate material of construction with the desired wetting characteristics. In general, aqueous phases wet metal surfaces and organic phases wet non-metallic surfaces. Changes in flows and physical properties along the length of an extractor can also be considered in selecting the type of extractor and/or the specific configuration, materials or construction, and packing material type and characteristics, such as average particle size, shape, density, surface area, and the like.

Figure 9:
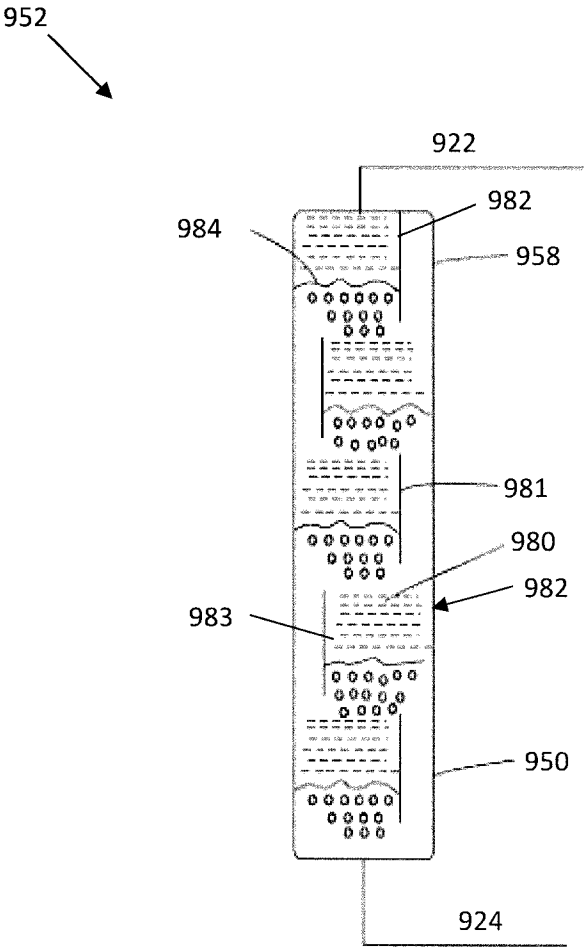

A tray column 952 is schematically illustrated in FIG. 9. A light liquid inlet 950 at the bottom of column 952 receives oxidized hydrocracked bottoms fraction, and a heavy liquid inlet 958 at the top of column 952 receives liquid solvent. Column 952 includes a plurality of trays 980 and associated downcomers 981. A top level baffle 982 physically separates incoming solvent from the liquid hydrocarbon that has been subjected to prior extraction stages in the column 952. Tray column 952 is a multi-stage counter-current contactor. Axial mixing of the continuous solvent phase occurs at region 982 between trays 980, and dispersion occurs at each tray 980 resulting in effective mass transfer of solute into the solvent phase. Trays 980 can be sieve plates having perforations ranging from about 1.5 to 4.5 mm in diameter and can be spaced apart about 150-600 mm.

Hydrocarbon liquid passes through the perforations in each tray 980 and emerges in the form of fine droplets. The fine hydrocarbon droplets rise through the continuous solvent phase and coalesce into an interface layer 983 and are again dispersed through the tray 980 above. Solvent passes across each plate and flows downward from tray 980 above to the tray 980 below via downcomer 981. A principal interface 984 is maintained at the top of column 952. A reduced HPNA effluent is removed from outlet 922 at the top of column 952 and oxidized HPNA byproduct is discharged through outlet 924 at the bottom of column 952. Tray columns are efficient solvent transfer apparatus and have desirable liquid handling capacity and extraction efficiency, particularly for systems of low-interfacial tension.

Figure 10:
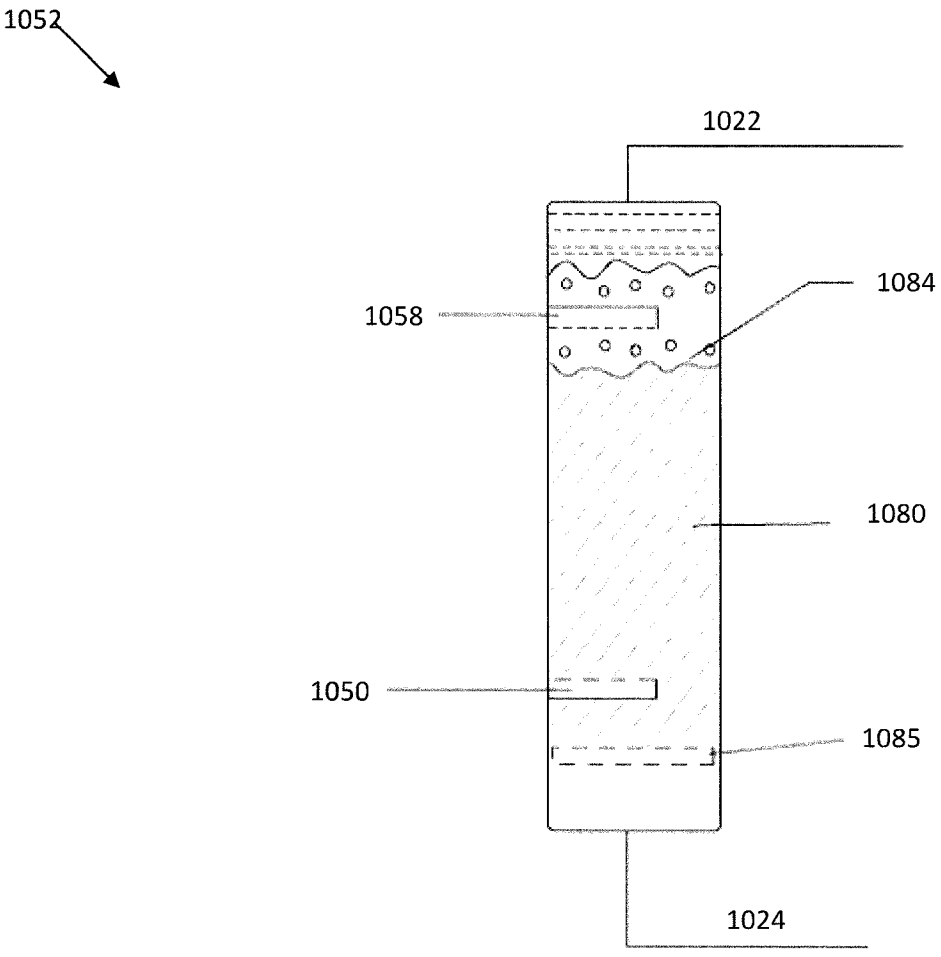

An additional type of unit operation suitable for extracting oxidized HPNA compounds from the oxidized hydrocracked bottoms fraction is a packed bed column. FIG. 10 is a schematic illustration of a packed bed column 1052 having an inlet 1050 for receiving the oxidized hydrocracked bottoms stream, and a solvent inlet 1058. A packing region 1080 is provided upon a support plate 1085. Packing region 1080 comprises suitable packing material including, but not limited to, Pall rings, Raschig rings, Kascade rings, Intalox saddles, Berl saddles, super Intalox saddles, super Berl saddles, Demister pads, mist eliminators, telerrettes, carbon graphite random packing, other types of saddles, and the like, including combinations of one or more of these packing materials. The packing material is selected so that it is fully wetted by the continuous solvent phase. The solvent introduced via inlet 1058 at a level above the top of the packing region 1080 flows downward and wets the packing material and fills a large portion of void space in the packing region 1080. Remaining void space is filled with droplets of the hydrocarbon liquid which rise through the continuous solvent phase and coalesce to form the liquid-liquid interface 1084 at the top of the packed bed column 1052. A reduced HPNA effluent is removed from outlet 1022 at the top of column 1052 and an oxidized HPNA byproduct is discharged through outlet 1024 at the bottom of column 1052. Packing material provides large interfacial areas for phase contacting, causing the droplets to coalesce and reform. The mass transfer rate in packed towers can be relatively high because the packing material lowers the recirculation of the continuous phase.

Figure 11:
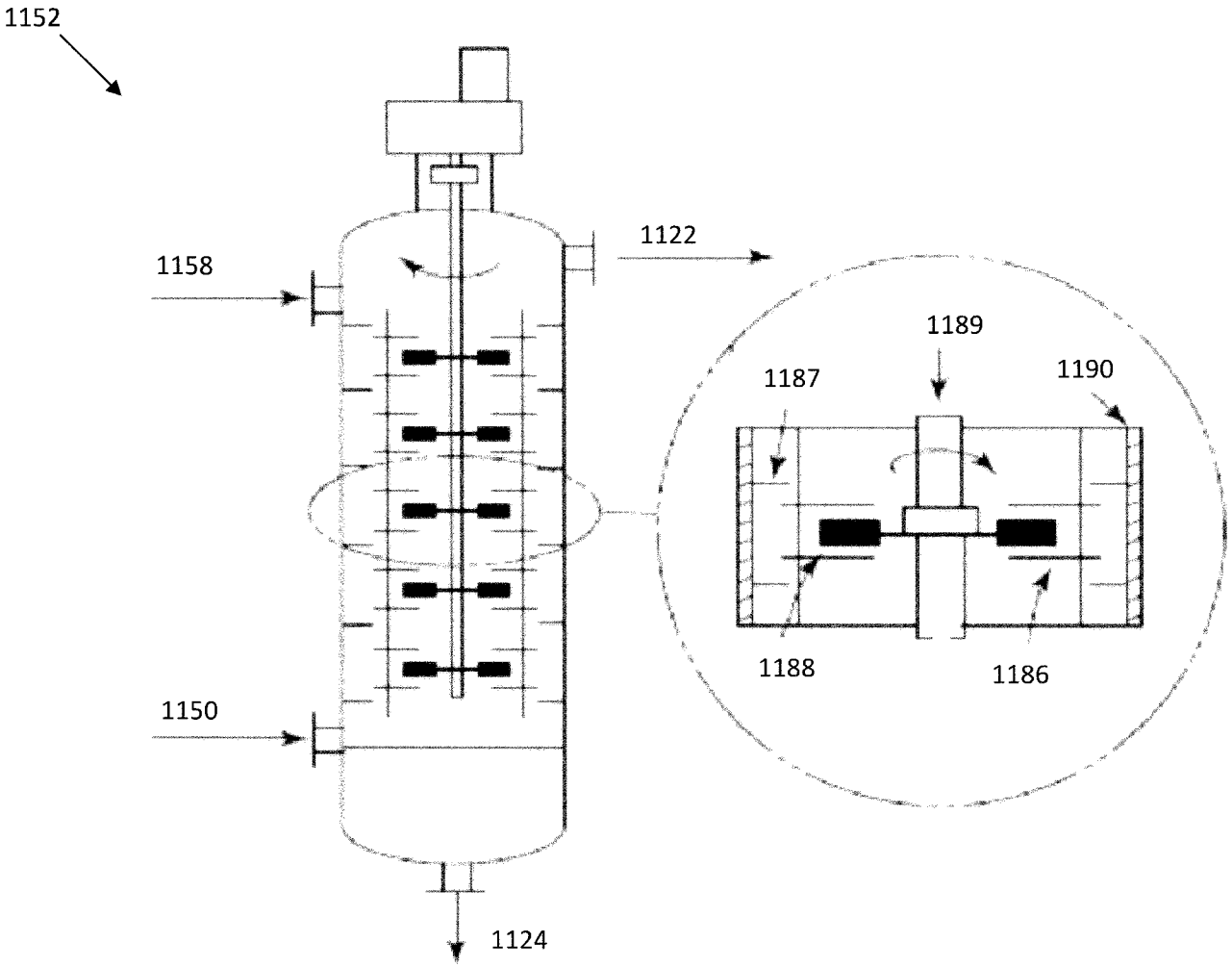

Further types of apparatus suitable for extracting oxidized HPNA compounds from the oxidized hydrocracked bottoms fraction include rotating disc contactors. FIG. 11 is a schematic illustration of a rotating disc contactor 1152 known as a Scheiebel® column commercially available from Koch Modular Process Systems, LLC of Paramus, N.J., USA. It will be appreciated by those of ordinary skill in the art that other types of rotating disc contactors can be implemented as a liquid-liquid solvent extraction unit included in the system and method herein, including but not limited to Oldshue-Rushton columns, and Kuhni extractors. The rotating disc contactor is a mechanically agitated, counter-current extractor. Agitation is provided by a rotating disc mechanism, which typically runs at much higher speeds than a turbine type impeller as described with respect to FIG. 11.

Rotating disc contactor 1152 includes an inlet 1150 toward the bottom of the column for receiving the oxidized hydrocracked bottoms stream, and a solvent inlet 1158 proximate the top of the column, and is divided into number of compartments formed by a series of inner stator rings 1186 and outer stator rings 1187. Each compartment contains a centrally located, horizontal rotor disc 1188 connected to a rotating shaft 1189 that creates a high degree of turbulence inside the column. The diameter of the rotor disc 1188 is slightly less than the opening in the inner stator rings 1186. Typically, the disc diameter is 33-66% of the column diameter. The disc disperses the liquid and forces it outward toward the vessel wall 1190 where the outer stator rings 1187 create quiet zones where the two phases can separate. A reduced HPNA effluent is removed from outlet 1122 at the top of column 1152 and an oxidized HPNA byproduct is discharged through outlet 1124 at the bottom of column 1152. Rotating disc contactors advantageously provide relatively high efficiency and capacity and have relatively low operating costs.

Figure 12B:
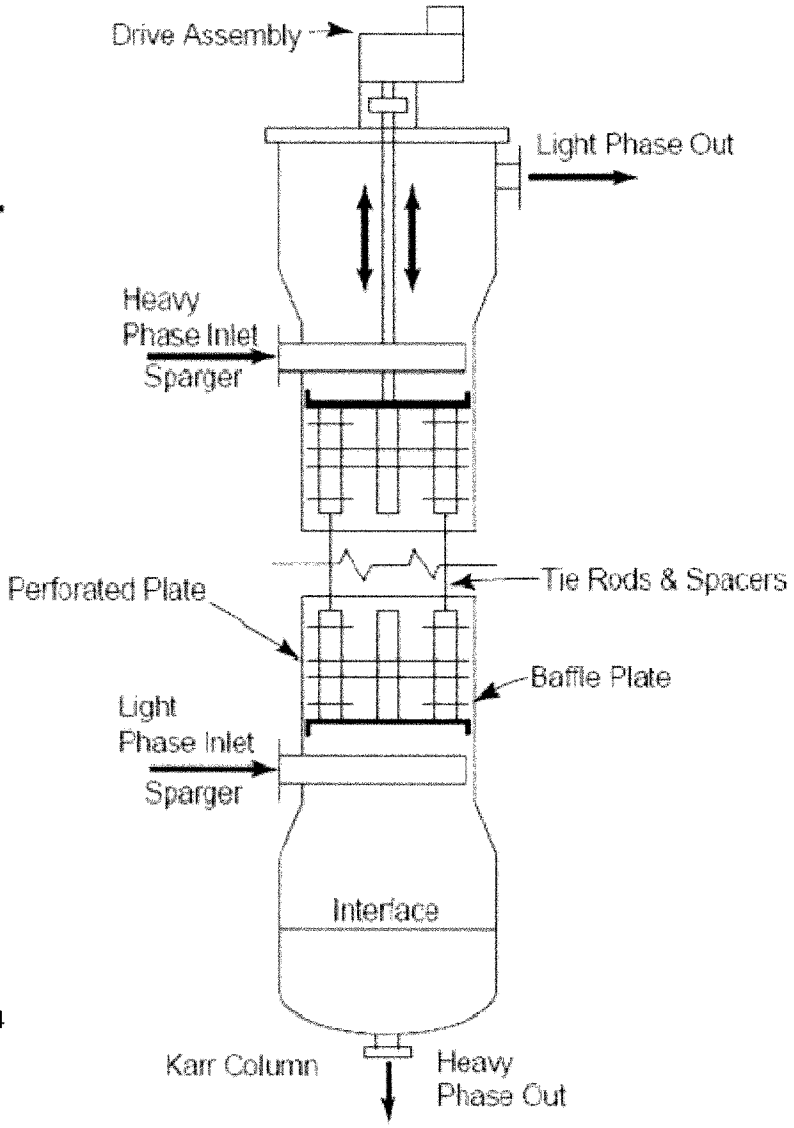
Figure 12A:
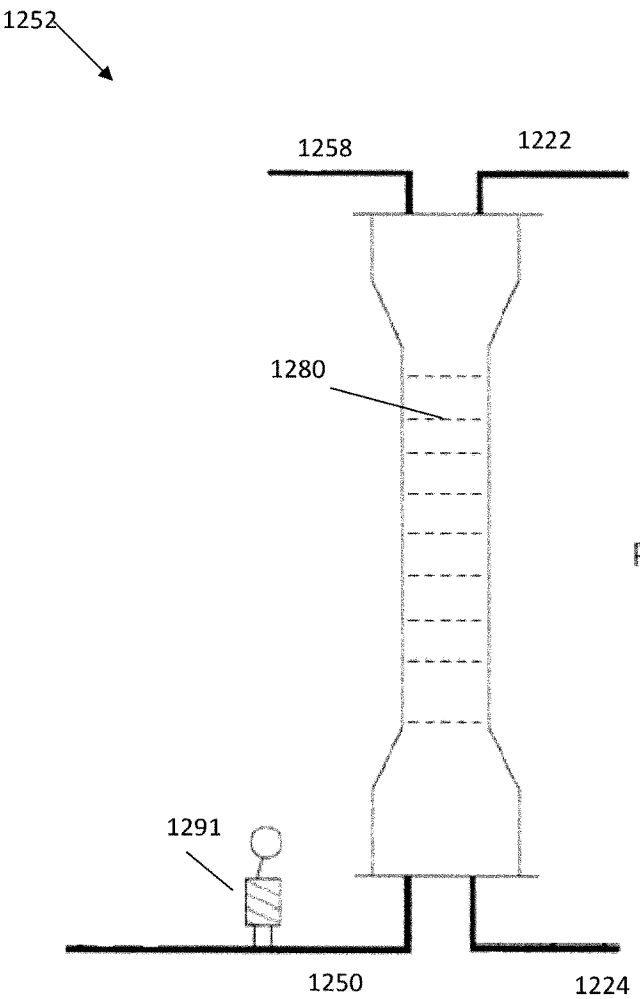

An additional type of apparatus suitable for extracting oxidized HPNA compounds from the oxidized hydrocracked bottoms fraction is a pulse column. FIG. 12A is a schematic illustration of a pulse column system 1252, which includes a column with a plurality of packing or sieve plates 1280, a solvent inlet 1258, a hydrocarbon feed inlet 1250, a light phase outlet 1222 for recovering a reduced HPNA effluent for recycle, and a heavy phase outlet 1224 for discharging an oxidized HPNA byproduct.

In general, pulse column system 1252 is a vertical column with a large number of sieve plates 1280 lacking downcomers. The perforations in the sieve plates 1280 typically are smaller than those of non-pulsating columns, such as about 1.5 mm to about 3.0 mm in diameter.

A pulse-producing device 1291, such as a reciprocating pump, pulses the contents of the column at frequent intervals. The rapid reciprocating motion, of relatively small amplitude, is superimposed on the usual flow of the liquid phases. Bellows or diaphragms formed of coated steel (for example, coated with polytetrafluoroethylene), or any other reciprocating, pulsating mechanism can be used. A pulse amplitude of 5-25 mm is generally recommended with a frequency of 100-260 cycles per minute. The pulsation causes the light liquid (solvent) to be dispersed into the heavy phase (oil) on the upward stroke and heavy liquid phase to jet into the light phase on the downward stroke. The column has no moving parts, low axial mixing, and high extraction efficiency.

A pulse column typically requires less than a third of the number of theoretical stages as compared to a non-pulsating column. A specific type of reciprocating mechanism is used in a Karr Column which is shown in FIG. 12B.

Figure 13A:
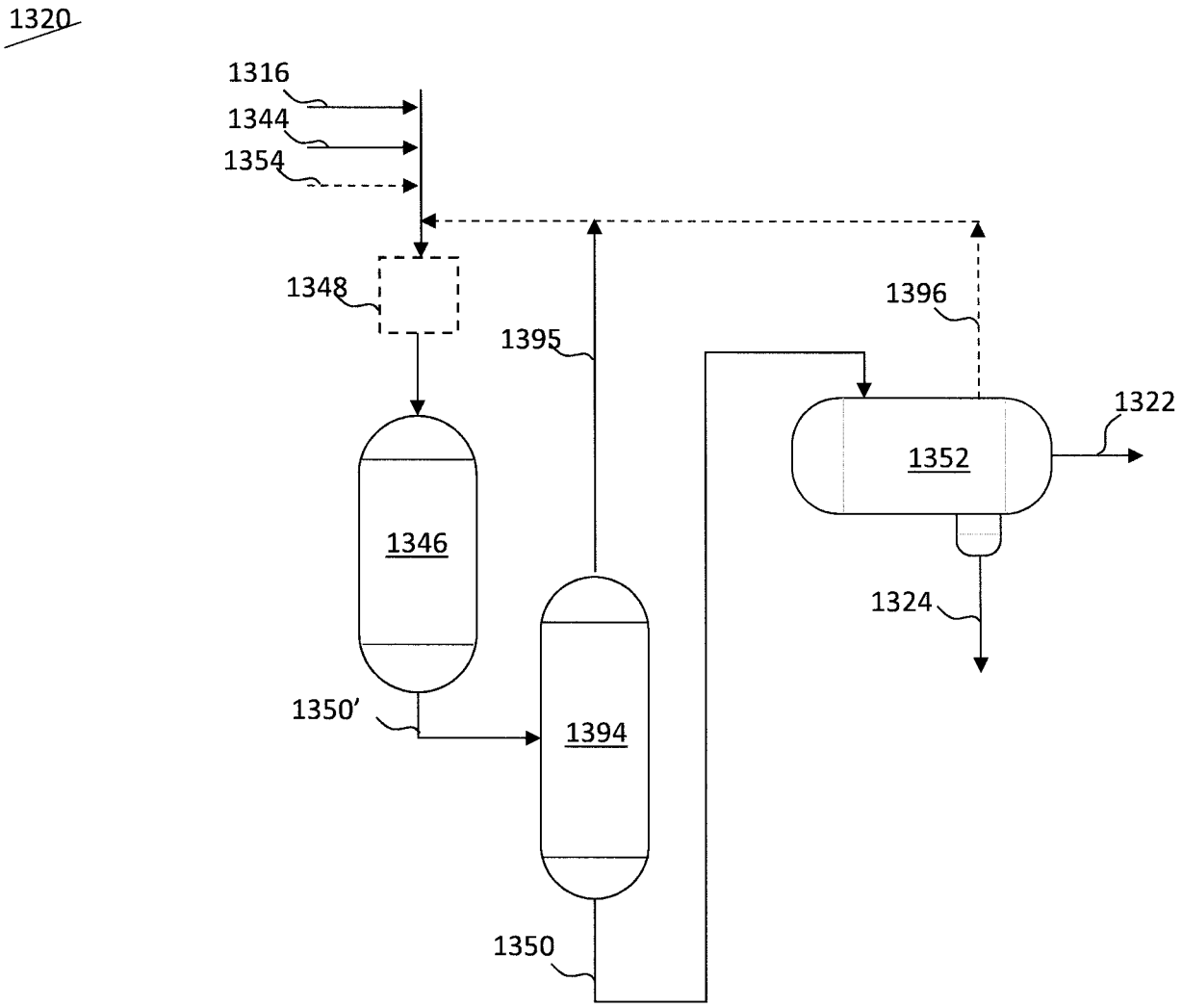
FIG. 13A is a process flow diagram of another embodiment of oxidation and separation of HPNA compounds from a hydrocracker bottoms by gas phase oxidation.
Figure 13C:
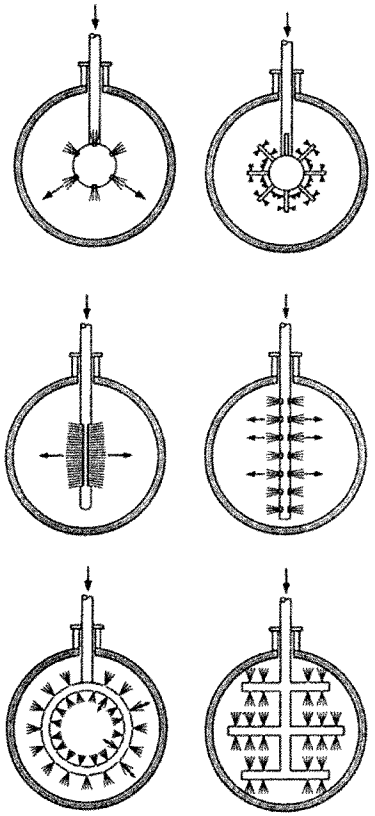
FIG. 13C are schematic diagrams of gas distributors suitable for use with gaseous oxidant dissolving operations compatible with the process of FIGS. 13A-13B.
Figure 13B:
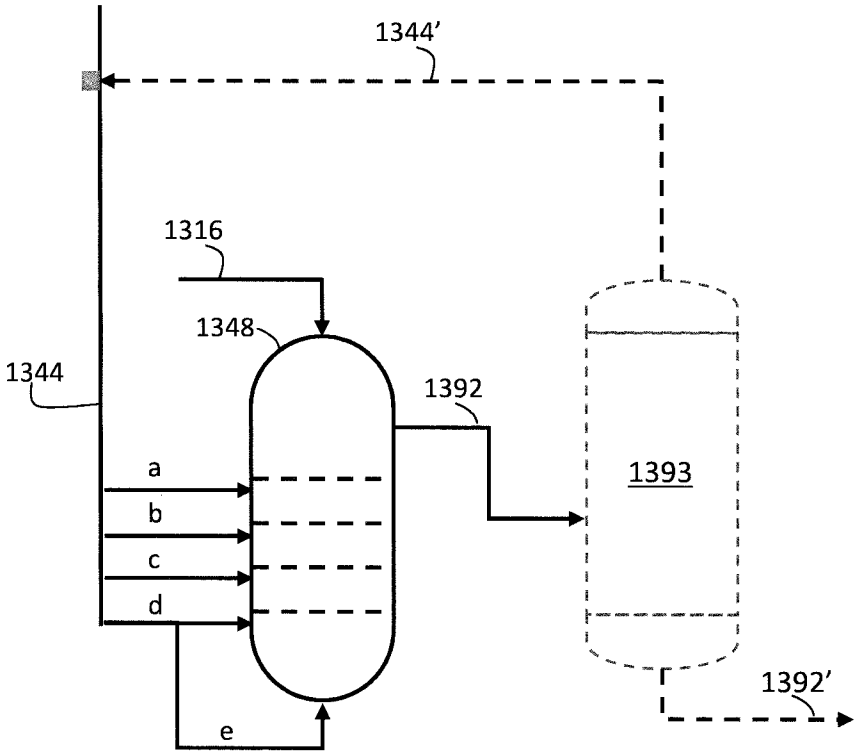
FIG. 13B is a schematic diagram of a dissolving system for a gaseous oxidant compatible with the process of FIG. 13A.

Referring to FIG. 13A, another method for separation of HPNA from a hydrocracked bottoms fraction is shown. A hydrocracked bottoms fraction is contacted with an effective quantity of gas phase oxidation agent and optionally an effective quantity of catalyst under reaction conditions suitable to oxidize HPNA compounds and form an oxidized hydrocracked bottoms fraction. In certain embodiments an excess gas phase oxidation agent is removed and optionally recycled to the contacting step. The oxidized hydrocracked bottoms fraction is separated into an HPNA-reduced hydrocracked bottoms fraction and an oxidized HPNA portion.

In one embodiment, an HPNA separation zone 1320 is similar in some respects to HPNA separation zone 420 described herein in conjunction with FIG. 4. A hydrocracked bottoms fraction 1316 containing HPNA compounds and a source of gaseous oxidant 1344 is in fluid communication with a reaction zone 1346. In certain embodiments, an optional feed 1354 is also charged to the oxidation reaction zone 1346. A contacting and/or mixing zone 1348 is optionally included, particularly in embodiments in which the reaction zone is designed to operate as a two-phase system including a solid catalyst phase and a liquid phase containing dissolved gaseous oxidant. The contacting and/or mixing zone 1348 can be provided upstream of reaction zone 1346 to promote intimate mixing of oil, oxidation agent, and optionally catalyst.

The optional mixing zone in the herein processes can be a suitable apparatus that achieves the necessary intimate mixing of the substantially liquid feedstock and gas so that sufficient gaseous oxidant is dissolved in the liquid recycle bottoms. In other embodiments, the mixing zone can include a combined inlet for the gaseous oxidant and the feedstock. Effective unit operations include one or more gas-liquid distributor vessels, which apparatuses can include spargers, injection nozzles, or other devices that impart sufficient velocity to inject the gaseous oxidant into the liquid hydrocarbon with turbulent mixing and thereby promote gas saturation into the feed. Suitable apparatus are described with respect to FIGS. 13B and 13C herein. In certain embodiments, such as, for example, shown in FIG. 13B, a column is used as a gas distributor vessel 1348, in which gaseous oxidant 1344 is injected at plural locations a, b, c, d and e. Gaseous oxidant is injected thru distributors into the column for adequate mixing to effectively dissolve gaseous oxidant in the feedstock. For instance, suitable injection nozzles can be provided proximate several plates (locations a-d) and also at the bottom of the column (location e). The hydrocracked bottoms fraction 1316 (or combination of the hydrocracked bottoms fraction 1316 and another feedstock 1354) can be fed from the bottom or top of the column.

In certain embodiments, the effluent 1392 is a mixture of hydrocracked bottoms fraction having oxidation agent dissolved therein and a very small amount of excess gas, so that at least all, a substantial portion, a significant portion, or a major portion of the mixture 1392 is in liquid phase, and serves as the oxidation agent-enhanced hydrocracked bottoms fraction is passed to the oxidation reaction zone 1346. In other embodiments, the effluent 1392 is a mixture of oxidant-enhanced hydrocracked bottoms fraction and excess gas that is flashed off in an optional gas separation unit 1393, and the oxidation agent-enhanced hydrocracked bottoms fraction 1392' is passed to the oxidation reaction zone 1346; gaseous oxidation agent can optionally be recycled as stream 1344'.

Various types of distributor apparatus can be used. For instance, referring to FIG. 13C, gas distributors can include tubular injectors fitted with nozzles and/or jets that are configured to uniformly distribute gaseous oxidant into the flowing hydrocarbon feedstock in a column or vessel in order to achieve a saturation state in the mixing zone. Note that the mixing zone is not required when the system operates as a three-phase system, including gaseous oxidant, liquid recycle bottoms and solid catalyst.

The reaction products 1350' can include excess gaseous oxidant. Accordingly, in certain embodiments, reaction products 1350' containing excess gaseous oxidant is passed to a gas recovery zone 1394. A gas stream 1395 containing excess oxidant from gas recovery zone 1394 is removed. The recovered excess oxidant 1395 is optionally recycled to the reaction zone 1346 or the contacting and/or mixing zone 1348. Reaction products 1350, which include oxidized aromatics formed in the reaction zone 1346, and the remaining hydrocarbons, are passed to a separation zone 1352 to obtain an HPNA-reduced hydrocracked bottoms fraction 1322 (for instance corresponding to streams 122, 222 and 322 above), and an oxidized HPNA phase 1324 (for instance corresponding to streams 124, 224 and 324 above).

In addition, in embodiments in which excess gas phase oxidant remains in the reaction product stream 1350, a gas stream 1396 can optionally be recovered from the separation zone 1352. If recovered, gas stream 1396 can be compressed (not shown) and recycled to the reaction zone 1346 or the contacting and/or mixing zone 1348. Separation zone 1352 can be any of the previously described separation processes or combination thereof, including a solvent extraction HPNA separation process in which oxidized HPNA compounds are rejected as precipitate described with respect to FIGS. 6 and 7, a liquid-liquid solvent extraction process based on selective aromatic solvents, such as those described with respect to FIGS. 8-11, 12A and 12B, or an aqueous separation process described with respect to FIG. 5.

Gas recovery zone 1394 can contain one or more strippers, flash separation vessels and/or distillation columns. The gas recovery units are generally operated under conditions compatible with the reactor effluents. For example, a gas recovery zone 1394 downstream of a high temperature reactor system can operate at a temperature in the range of about 200° C. to 300° C. and a pressure in the range of from about 1-10 or 3-5 bars. A gas recovery zone 1394 downstream of a low temperature reactor systems can operate at a temperature in the range of about 40° C. to 100° C. and a pressure in the range of from about 1-10 or 3-5 bars.

Reaction zone 1346 can contain one or more suitable reactors such as fixed-bed, ebullated-bed, slurry-bed, moving bed, continuous stirred tank, fluidized bed, or tubular reactors, in series and/or parallel arrangement. The reactor (s) are generally operated under conditions effective for the particular type of reactor, the feed characteristics, and the desired oxidation conversion, and to promote reaction with aromatics to produce aromatic oxides and form an oxidized hydrocracked bottoms fraction, as noted herein.

The source of oxidation agent 1344 contains an effective concentration of gas phase oxidation agent(s) such as air, oxygen, oxides of nitrogen, ozone, $SO_2$, $SO_3$, and combinations thereof. Oxidation reactions can occur in the presence or absence of catalysts such as metal oxide having the formula MxOy, wherein M is an element selected from the Periodic Table of the Elements IUPAC Groups 4, 5 and 6. In embodiments using gas phase oxidant, effective catalysts include Cu—Zn/Al type catalysts, and those or modified Mo, W, and/or B. In addition, one or more co-catalysts or phase transfer agents can be included, such as acetic acid. In certain embodiments phase transfer agents are provided to facilitate the biphasic reaction, including a quaternary ammonium halide.

Example

Figure 14:
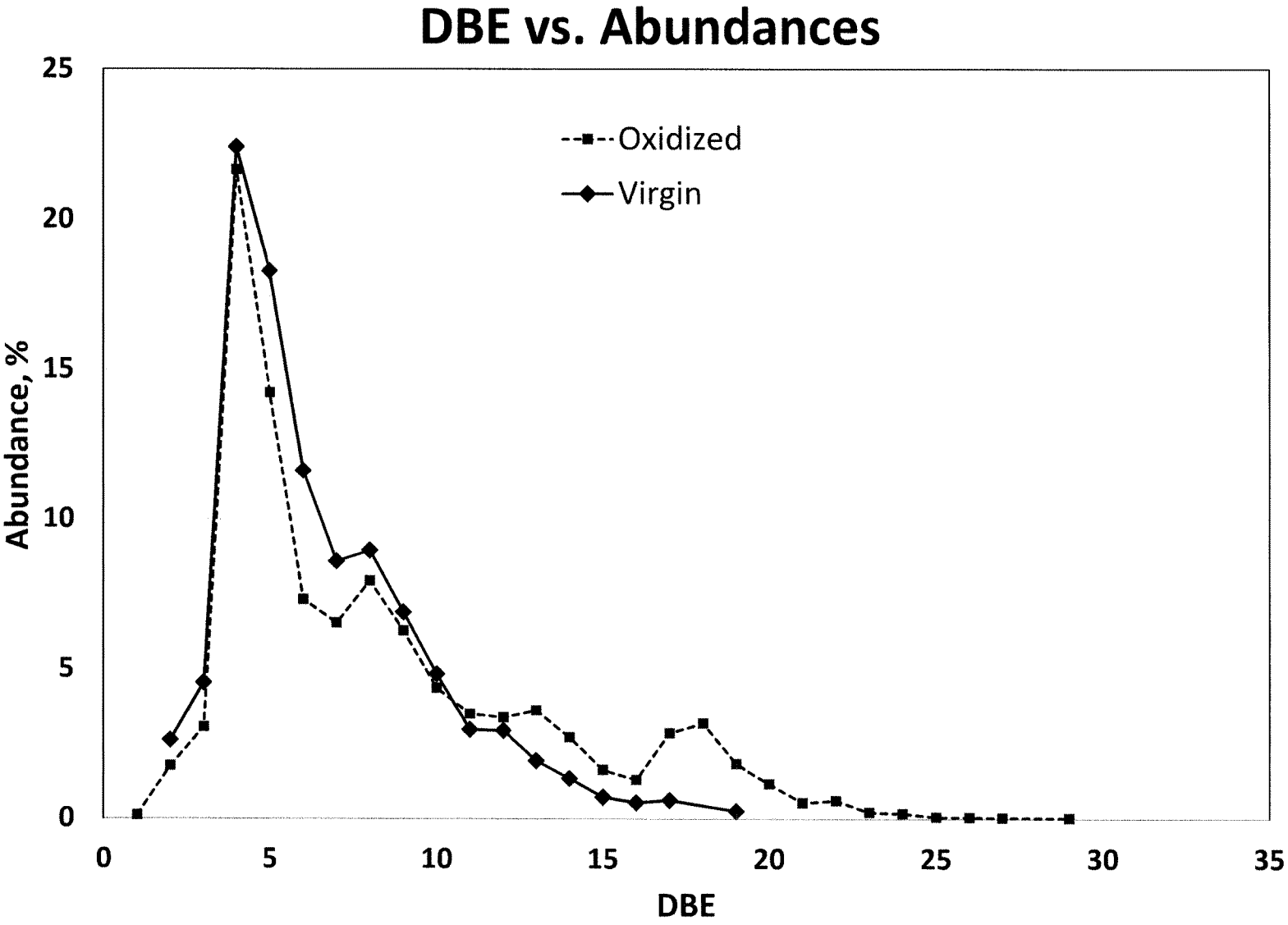
FIG. 14 is a plot of HPNA content in an example herein for hydrocracker bottoms and product obtained after oxidation, showing double bond equivalence of the hydrocarbons as a function of the abundance.

A 0.3 gram sample of sodium tungstate ($Na_2WO_4.2H_2O$) was added to a flask and mixed with 24 grams of acetic acid as a co-catalyst or phase-transfer agent. 20 grams of hydrocracker bottoms recycle and 24 grams of hydrogen peroxide were added to the mixture and then refluxed at 80° C. for one hour. The mixture was then cooled to room temperature, 20° C. The reflux and cooling were carried out with a coolant flowing in a condenser at 10° C. Two-phases in separate layers were observed: A yellow oil phase was the top layer and a black aqueous phase was the bottom layer. The two phases were separated and a sample of each was taken for analysis. The oil phase was analyzed using FT-MS and was compared to the virgin hydrocracker bottoms recycle stream. FIG. 14 depicts the FT-MS results showing the oxidized stream compared to the virgin stream.

From FIG. 14, it is clear that the hydrocracker bottoms recycle stream contained a small amount of HPNA. The HPNA concentration of the hydrocracker bottoms recycle stream was determined to be 0.29 W % based on the FT-MS intensities. When the HPNAs and HPNA precursors are oxidized, the HPNA concentration increases to 4.6 W %.

Figure 15A:
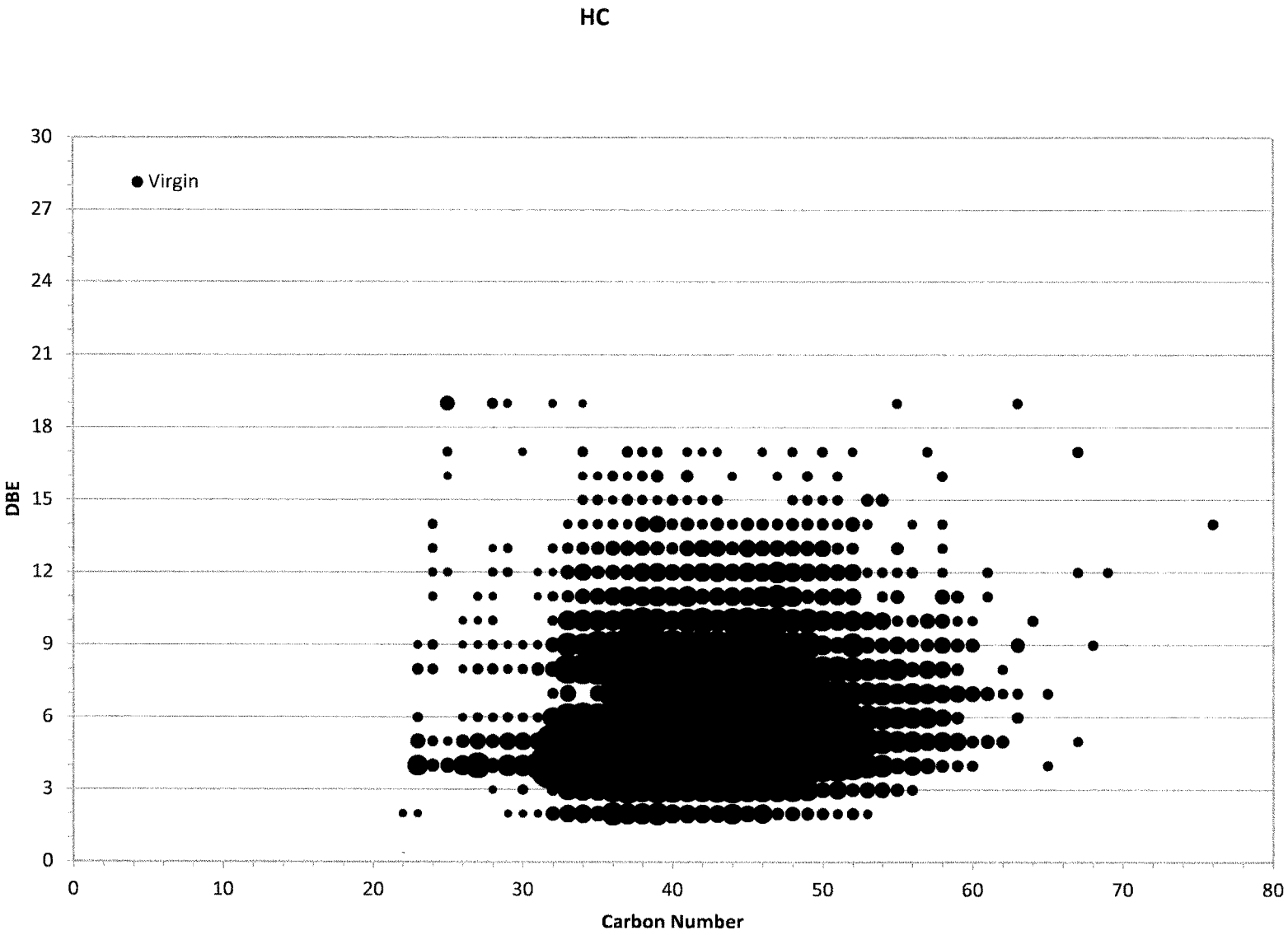
FIGS. 15A and 15B are plots of the DBE and peak intensities as a function of carbon number for the HPNA molecules before and after oxidation.
Figure 15B:
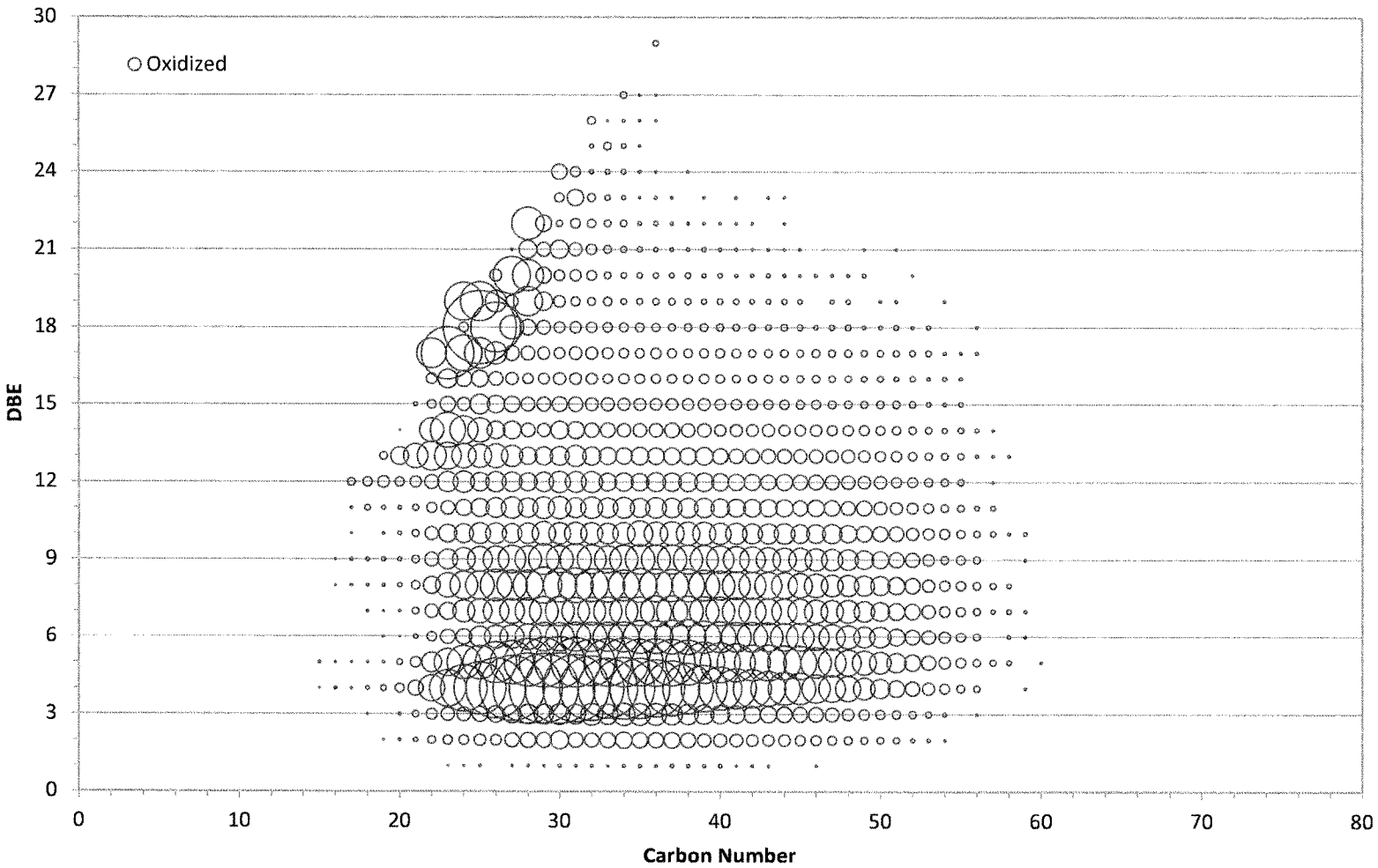

FIGS. 15A and 15B plot the DBE peak intensities as a function of carbon number for the HPNA molecules in the virgin hydrocracker bottoms recycle stream (FIG. 15A) and in the oxidized hydrocracker recycle stream (FIG. 15B). The peak intensities are relative to the size of the bubble shown. It is clear that the oxidized HPNAs and/or HPNA precursors have higher DBEs when compared to the hydrocracker recycle stream.

Heteroatoms of both the original hydrocracker bottoms recycle stream and the oxidized stream were also determined by an FT-MS analysis. The recycle stream has little or no heteroatoms as it is cleaned in the process. However, the oxidized recycle stream has a substantial amount of oxygenates as a result of oxidation, shown in Table 2. These species are substantially removed when a solvent extraction HPNA separation process using non-polar solvent is carried out (for example, shown with respect to FIGS. 6 and 7).

TABLE 2

| | Molecule Type, % | | | | | | | |
|---|---|---|---|---|---|---|---|---|
| | HC | S | O | O2 | S2 | O3 | O2S | O3S2 |
| Oxidized | 92.4 | 3.0 | 2.7 | 0.7 | 0.6 | 0.3 | 0.2 | 0.1 |

While not shown, the skilled artisan will understand that additional equipment, including exchangers, furnaces, pumps, columns, and compressors to feed the reactors, maintain proper operating conditions, and to separate reaction products, are all part of the systems described.

The method and system of the present invention have been described above and in the attached drawings; however, modifications will be apparent to those of ordinary skill in the art and the scope of protection for the invention is to be defined by the claims that follow.

The invention claimed is:

1. A two stage hydrocracking process for hydrocracking of a vacuum gas oil, a demetallized oil, a deasphalted oil, a coker gas oil, a cycle oil or a visbroken oil hydrocarbon stream, the process comprising:

subjecting the vacuum gas oil, demetallized oil, deasphalted oil, coker gas oil, cycle oil or visbroken oil hydrocarbon stream to a first hydrocracking stage to produce a first hydrocracked effluent;

fractionating the first hydrocracked effluent to recover one or more hydrocracked product fractions and a bottoms fraction corresponding to the hydrocracked bottoms fraction, wherein the hydrocracker bottoms fraction contains heavy poly nuclear aromatic (HPNA) compounds that are formed during hydrocracking reactions;

separating HPNA compounds from the hydrocracked bottoms fraction by contacting the hydrocracked bottoms fraction with an effective quantity of an oxidation agent to promote reaction with HPNA compounds to produce corresponding oxidized HPNA compounds and to form an oxidized hydrocracked bottoms fraction, separating the oxidized hydrocracked bottoms fraction into an HPNA-reduced hydrocracked bottoms portion and an oxidized HPNA portion, and discharging the oxidized HPNA portion;

passing all or a portion of the HPNA-reduced hydrocracked bottoms portion to a second hydrocracking stage to produce a second hydrocracked effluent; and subjecting the second hydrocracked effluent to fractionating with the first hydrocracked effluent.

2. The process as in claim 1, further comprising contacting an additional feed with the oxidation agent.

3. The process as in claim 2, wherein the additional feed is selected from the group consisting of one or more of straight run vacuum gas oil, treated vacuum gas oil, demetallized oil from solvent demetallizing operations, deasphalted oil from solvent deasphalting operations, coker gas oils from coker operations, cycle oils from fluid catalytic cracking operations including heavy cycle oil, and visbroken oils from visbreaking operations, and wherein the additional feed has a boiling point range within about 350-800° C.

4. The process as in claim 1, wherein the oxidation agent is liquid phase, and wherein contacting the hydrocracked bottoms fraction with the liquid phase oxidation agent occurs under operating conditions including a reaction temperature in the range of from about 0-150° C., a reaction pressure in the range of from about 1-30 bars, an oxidation agent to aromatic carbon containing compounds (molar ratio) of from about 1:1-15:1, and a feed rate liquid hourly space velocity based on the volume of the reactor in the range of from about 0.5-20 $h^{-1}$.

5. The process as in claim 4, wherein the oxidation agent is selected from the group consisting of peroxides, hydroperoxides, organic peracids, and combinations including at least one of peroxides, hydroperoxides or organic peracids.

6. The process as in claim 4, wherein contacting the hydrocracked bottoms fraction with the oxidation agent comprises introducing the oxidation agent and the hydrocracked bottoms fraction into an oxidation reaction zone.

7. The process as in claim 4, wherein contacting the hydrocracked bottoms fraction with the oxidation agent comprises introducing the oxidation agent and the hydrocracked bottoms fraction into a contacting and/or mixing zone to promote intimate mixing of oil and oxidation agent and to produce a mixture, and passing the mixture to an oxidation reaction zone to promote reaction with HPNA compounds to produce corresponding oxidized HPNA compounds and to form the oxidized hydrocracked bottoms fraction.

8. The process as in claim 1, wherein the oxidation agent is gas phase and is selected from the group consisting of air, oxygen, oxides of nitrogen, ozone, $SO_2$, $SO_3$ and combinations including at least one of air, oxygen, oxides of nitrogen, ozone, $SO_2$, or $SO_3$, and wherein contacting the hydrocracked bottoms fraction with an effective quantity of a oxidation agent occurs under operating conditions including a reaction temperature in the range of from about 20-600° C., a reaction pressure in the range of from about 0.01 (vacuum)-100 bars, an oxidation agent to aromatic carbon containing compounds (molar ratio) of from about 1:1-15:1, and a feed rate liquid hourly space velocity based on the volume of the reactor in the range of from about 0.5-20 $h^{-1}$.

9. The process as in claim 8, wherein contacting the hydrocracked bottoms fraction with the oxidation agent comprises introducing the oxidation agent and the hydrocracked bottoms fraction into an oxidation reaction zone.

10. The process as in claim 8, wherein contacting the hydrocracked bottoms fraction with the oxidation agent comprises introducing the oxidation agent and the hydrocracked bottoms fraction into a contacting and/or mixing zone to promote intimate mixing of oil and oxidation agent and to produce a mixture, and passing the mixture to an oxidation reaction zone to promote reaction with HPNA compounds to produce corresponding oxidized HPNA compounds and to form the oxidized hydrocracked bottoms fraction.

11. The process as in claim 10, wherein the contacting and/or mixing zone comprises a gas distributor vessel in which gaseous oxidation agent is injected at plural locations through distributors into the vessel for adequate mixing to effectively dissolve gaseous oxidation agent in the hydrocracked bottoms fraction.

12. The process as in claim 8, further comprising discharging excess gas phase oxidation agent either:

before separation of the oxidized bottoms fraction into an HPNA-reduced bottoms portion and an oxidized HPNA portion; or during separation of the oxidized bottoms fraction into an HPNA-reduced bottoms portion and an oxidized HPNA portion.

13. The process as in claim 12, further comprising recycling excess gas phase oxidation agent to the contacting step.

14. The process as in claim 1, wherein the oxidized HPNA compounds are polar; and wherein separating the oxidized hydrocracked bottoms fraction comprises contacting the oxidized hydrocracked bottoms fraction with an effective quantity of non-polar solvent and under conditions effective to form a precipitated phase containing oxidized HPNA compounds as the oxidized HPNA portion, and a soluble phase containing non-polar solvent and soluble compounds from the oxidized hydrocracked bottoms fraction, wherein the HPNA-reduced hydrocracked bottoms portion is obtained from the soluble phase.

15. The process as in claim 14, wherein the contacting occurs at temperature at or below the critical point of the non-polar solvent, a solvent-to-oil ratio (V/V) in the range of from about 2:1-50:1, and a pressure in a range that is effective to maintain the solvent/feed mixture in liquid phase.

16. The process as in claim 14, further comprising separating non-polar solvent from the soluble phase and recovering the HPNA-reduced hydrocracked bottoms portion.

17. The process as in claim 14, wherein the contacting comprises:

admixing the oxidized hydrocracked bottoms fraction and the non-polar solvent;

transferring the mixture of the oxidized hydrocracked bottoms fraction and the non-polar solvent to a settler to form the soluble phase and the precipitated phase;

discharging the precipitated phase as the oxidized HPNA portion; and separating non-polar solvent from the soluble phase and recovering the HPNA-reduced hydrocracked bottoms portion.

18. The process as in claim 14, wherein the contacting comprises:

admixing the oxidized hydrocracked bottoms fraction and the non-polar solvent;

transferring the mixture of the oxidized hydrocracked bottoms fraction and the non-polar solvent to a primary settler to form a primary soluble phase and a primary precipitated phase;

passing the primary soluble phase to a secondary settler to form a secondary soluble phase and a secondary precipitated phase;

separating non-polar solvent from the primary HPNA phase and discharging the secondary precipitated phase as the oxidized HPNA portion; and separating non-polar solvent from the secondary soluble phase and discharging the HPNA-reduced hydrocracked bottoms portion.

19. The process as in claim 1, wherein the oxidized hydrocracked bottoms fraction includes water, and wherein the mixture is phase separated into an aqueous phase containing at least a part of the oxidized HPNA portion and an oil phase containing at least a part of the HPNA-reduced hydrocracked bottoms portion.

20. The process as in claim 19, wherein the oxidation agent is provided in an aqueous solution, and wherein the water in the oxidized hydrocracked bottoms fraction is derived from the aqueous solution.

21. The process as in claim 19, wherein the water in the oxidized hydrocracked bottoms fraction is added prior to or during phase separating.

22. The process as in claim 1, wherein separating the oxidized hydrocracked bottoms fraction comprises contacting the oxidized hydrocracked bottoms fraction with an effective quantity of aromatic selective solvent and under conditions effective to form an extract phase containing the oxidized HPNA portion, and a raffinate phase containing the HPNA-reduced hydrocracked bottoms portion.

23. A hydrocracking process for hydrocracking of a vacuum gas oil, a demetallized oil, a deasphalted oil, a coker gas oil, a cycle oil or a visbroken oil hydrocarbon stream, the process comprising:

subjecting the vacuum gas oil, demetallized oil, deasphalted oil, coker gas oil, cycle oil or visbroken oil hydrocarbon stream to one or more hydrocracking stages to produce a hydrocracked effluent; and fractionating the hydrocracked effluent to recover one or more hydrocracked product fractions and a hydrocracked bottoms fraction, wherein the hydrocracker bottoms fraction contains heavy poly nuclear aromatic (HPNA) compounds that are formed during hydrocracking reactions;

separating HPNA compounds from the hydrocracked bottoms fraction by contacting the hydrocracked bottoms fraction with an effective quantity of an oxidation agent to promote reaction with HPNA compounds to produce corresponding oxidized HPNA compounds and to form an oxidized hydrocracked bottoms fraction, separating the oxidized hydrocracked bottoms fraction into an HPNA-reduced hydrocracked bottoms portion and an oxidized HPNA portion, and discharging the oxidized HPNA portion; and recycling all or a portion of the HPNA-reduced hydrocracked bottoms portion to at least one of the one or more hydrocracking stages.

24. The process as in claim 23, further comprising contacting an additional feed with the oxidation agent, wherein the additional feed is selected from the group consisting of one or more of straight run vacuum gas oil, treated vacuum gas oil, demetallized oil from solvent demetallizing operations, deasphalted oil from solvent deasphalting operations, coker gas oils from coker operations, cycle oils from fluid catalytic cracking operations including heavy cycle oil, and visbroken oils from visbreaking operations, and wherein the additional feed has a boiling point range within about 350-800° C.

25. The process as in claim 23, wherein the oxidation agent is liquid phase and is selected from the group consisting of peroxides, hydroperoxides, organic peracids, and combinations including at least one of peroxides, hydroperoxides or organic peracids, and wherein contacting the hydrocracked bottoms fraction with the liquid phase oxidation agent occurs under operating conditions including a reaction temperature in the range of from about 0-150° C., a reaction pressure in the range of from about 1-30 bars, an oxidation agent to aromatic carbon containing compounds (molar ratio) of from about 1:1-15:1, and a feed rate liquid hourly space velocity based on the volume of the reactor in the range of from about 0.5-20 $h^{-1}$.

26. The process as in claim 25, wherein contacting the hydrocracked bottoms fraction with the oxidation agent comprises introducing the oxidation agent and the hydrocracked bottoms fraction into a contacting and/or mixing zone to promote intimate mixing of oil and oxidation agent and to produce a mixture, and passing the mixture to an oxidation reaction zone to promote reaction with HPNA compounds to produce corresponding oxidized HPNA compounds and to form the oxidized hydrocracked bottoms fraction.

27. The process as in claim 23, wherein the oxidation agent wherein the oxidation agent is gas phase and is selected from the group consisting of air, oxygen, oxides of nitrogen, ozone, $SO_2$, $SO_3$ and combinations including at least one of air, oxygen, oxides of nitrogen, ozone, $SO_2$, or $SO_3$, and wherein contacting the hydrocracked bottoms fraction with an effective quantity of a oxidation agent occurs under operating conditions including a reaction temperature in the range of from about 20-600° C., a reaction pressure in the range of from about 0.01 (vacuum)-100 bars, an oxidation agent to aromatic carbon containing compounds (molar ratio) of from about 1:1-15:1, and a feed rate liquid hourly space velocity based on the volume of the reactor in the range of from about 0.5-20 $h^{-1}$.

28. The process as in claim 27, wherein contacting the hydrocracked bottoms fraction with the oxidation agent comprises introducing the oxidation agent and the hydrocracked bottoms fraction into a contacting and/or mixing zone to promote intimate mixing of oil and oxidation agent and to produce a mixture, and passing the mixture to an oxidation reaction zone to promote reaction with HPNA compounds to produce corresponding oxidized HPNA compounds and to form the oxidized hydrocracked bottoms fraction.

29. The process as in claim 28, wherein the contacting and/or mixing zone comprises a gas distributor vessel in which gaseous oxidation agent is injected at plural locations through distributors into the vessel for adequate mixing to effectively dissolve gaseous oxidation agent in the hydrocracked bottoms fraction.

30. The process as in claim 23, wherein the oxidized HPNA compounds are polar; and wherein separating the oxidized hydrocracked bottoms fraction comprises contacting the oxidized hydrocracked bottoms fraction with an effective quantity of non-polar solvent and under conditions effective to form a precipitated phase containing oxidized HPNA compounds as the oxidized HPNA portion, and a soluble phase containing non-polar solvent and soluble compounds from the oxidized hydrocracked bottoms fraction, wherein the HPNA-reduced hydrocracked bottoms portion is obtained from the soluble phase.

31. The process as in claim 23, wherein the oxidized hydrocracked bottoms fraction includes water, and wherein the mixture is phase separated into an aqueous phase containing at least a part of the oxidized HPNA portion and an oil phase containing at least a part of the HPNA-reduced hydrocracked bottoms portion.

32. The process as in claim 23, wherein separating the oxidized hydrocracked bottoms fraction comprises contacting the oxidized hydrocracked bottoms fraction with an effective quantity of aromatic selective solvent and under conditions effective to form an extract phase containing the oxidized HPNA portion, and a raffinate phase containing the HPNA-reduced hydrocracked bottoms portion.

* * * * *